US011413204B2

(12) United States Patent
Sanaei et al.

(10) Patent No.: US 11,413,204 B2
(45) Date of Patent: Aug. 16, 2022

(54) LIFTING, MOBILITY, AND REHABILITATION APPARATUS FOR DISABLED PATIENTS

(71) Applicants: Alireza Sanaei, Shiraz (IR); Ehsan Azadi Yazdi, Shiraz (IR); Negar Kouchak dezfouli, Shiraz (IR); Mohammad Karim Najah, Shiraz (IR); Seyed Alireza Razavi, Shiraz (IR); Elnaz Kohanpour, Shiraz (IR); Mahsa Kheirandish, Shiraz (IR)

(72) Inventors: Alireza Sanaei, Shiraz (IR); Ehsan Azadi Yazdi, Shiraz (IR); Negar Kouchak dezfouli, Shiraz (IR); Mohammad Karim Najah, Shiraz (IR); Seyed Alireza Razavi, Shiraz (IR); Elnaz Kohanpour, Shiraz (IR); Mahsa Kheirandish, Shiraz (IR)

( * ) Notice: Subject to any disclaimer, the term of this patent is extended or adjusted under 35 U.S.C. 154(b) by 52 days.

(21) Appl. No.: 17/022,213

(22) Filed: Sep. 16, 2020

(65) Prior Publication Data

US 2021/0045953 A1 Feb. 18, 2021

Related U.S. Application Data

(60) Provisional application No. 62/900,666, filed on Sep. 16, 2019.

(51) Int. Cl.
*A61G 7/16* (2006.01)
*A61G 7/10* (2006.01)
(Continued)

(52) U.S. Cl.
CPC ..... *A61G 7/16* (2013.01); *A61G 5/006* (2013.01); *A61G 5/041* (2013.01); *A61G 5/122* (2016.11);
(Continued)

(58) Field of Classification Search
CPC ..... A61H 3/008; A61H 1/005; A61G 5/14; A61G 2200/36; A61G 2203/10
See application file for complete search history.

(56) References Cited

U.S. PATENT DOCUMENTS 5,489,258 A * 2/1996 Wohnsen ..... A61G 5/14 280/250.1
2004/0267175 A1* 12/2004 Harnois ..... A61G 5/121 602/5

FOREIGN PATENT DOCUMENTS

CN 105832474 A * 8/2016
EP 2004124 B1 * 5/2012 ..... A61G 5/1059
(Continued)

*Primary Examiner* — Peter M. Cuomo
*Assistant Examiner* — Adam C Ortiz
(74) *Attorney, Agent, or Firm* — Bajwa IP Law Firm; Haris Zaheer Bajwa

(57) ABSTRACT

A mobility device that includes support assemblies that may be secured to feet, legs, thighs, and torso of a user. An exemplary mobility device may further include an actuator that may be coupled with the exemplary support assemblies and may actuate rotational movements of the exemplary support assemblies with respect to each other. Such movement of support assemblies may accordingly move respective limbs of a disabled user. An exemplary mobility device may allow for a user to change position from a lying position to a standing position or from a standing position to a sitting position, which may significantly increase mobility of a disabled user. An exemplary mobility device may further include an exemplary wheeled base that may allow a disabled user to further move around.

17 Claims, 13 Drawing Sheets

(51) Int. Cl.

| | |
|---|---|
| ***A61G 5/04*** | (2013.01) |
| ***A61G 5/00*** | (2006.01) |
| ***A61G 5/12*** | (2006.01) |
| ***A61G 5/14*** | (2006.01) |
| ***A61G 7/05*** | (2006.01) |
| ***A61G 5/10*** | (2006.01) |

(52) U.S. Cl.

CPC ..... *A61G 5/124* (2016.11); *A61G 5/127* (2016.11); *A61G 5/128* (2016.11); *A61G 5/14* (2013.01); *A61G 7/109* (2013.01); *A61G 7/1015* (2013.01); *A61G 7/1048* (2013.01); *A61G 7/1057* (2013.01); *A61G 7/1059* (2013.01); *A61G 7/1086* (2013.01); *A61G 7/1096* (2013.01); *A61G 7/1098* (2013.01); *A61G 5/1051* (2016.11); *A61G 7/0528* (2016.11); *A61G 2203/14* (2013.01)

(56) References Cited

FOREIGN PATENT DOCUMENTS

| | | | | | |
|---|---|---|---|---|---|
| FR | 2965716 | A1 * | 4/2012 | ..... | A61G 5/14 |
| WO | WO-2017199164 | A1 * | 11/2017 | ..... | A61G 5/14 |

* cited by examiner

LIFTING, MOBILITY, AND REHABILITATION APPARATUS FOR DISABLED PATIENTS

CROSS-REFERENCE TO RELATED APPLICATION

This application claims the benefit of priority from U.S. Provisional Patent Application Ser. No. 62/900,666, filed on Sep. 18, 2019, and entitled "LIFT, MOBILITY AND REHABILITATION APPARATUS FOR DISABLED PEOPLE," which is incorporated herein by reference in its entirety.

TECHNICAL FIELD

The present disclosure relates to mobility and rehabilitation devices. More particularly, the present disclosure relates to a lifting, mobility, and rehabilitation device for supporting a disabled patient in lying, sitting, and standing positions.

BACKGROUND

Enabling injured, disabled, or handicapped individuals who have lost all or a part of their control over their movements to have a degree of mobility is the ultimate goal in designing lifting, mobility and rehabilitation devices. Specifically, mobility devices that allow a user to move around and change positions between sitting and standing positions may help disabled people to achieve independence in movement.

Many attempts have been made to design mobility devices that allow such movements and posture changes, for example, wheelchairs have been designed that allow a user to change posture between a sitting position to a standing position. Such wheelchairs may allow a disabled person to move around in a standing position. However, a disabled individual lying on a bed still needs to somehow get up onto such wheelchairs which poses many difficulties for a user. Most of mobility devices, such as the aforementioned wheelchair or other devices such as exoskeletons are only able to allow a user to sit or stand, but are not able to allow a user to lie down. It may be beneficial for a disabled person to change postures between a lying position and a standing position or between a lying position and a sitting position in certain situations.

There is, therefore, a need for a mobility device that may allow a user to change postures among sitting, standing, and lying positions in a stable manner. Such a mobility device may allow a disabled individual to easily lay down, sit up, or stand up without any external assistance. The ability of gaining such maneuverability may provide many physical medical benefits, such as an easy transfer of a patient to or from a hospital bed, placing a patient in different positions for imaging or other therapeutic activities. Such maneuverability may further increase independence and morale of a patient.

SUMMARY

This summary is intended to provide an overview of the subject matter of the present disclosure and is not intended to identify essential elements or key elements of the subject matter, nor is it intended to be used to determine the scope of the claimed implementations. The proper scope of the present disclosure may be ascertained from the claims set forth below in view of the detailed description and the drawings.

The present disclosure is directed to exemplary embodiments of a mobility device. An exemplary mobility device may include a wheeled chassis and a platform that may be mounted on an exemplary wheeled chassis. An exemplary top surface of an exemplary platform may be configured to support a user's feet. An exemplary mobility device may further include a pair of extended bars that may be attached to a respective side of an exemplary platform, where each extended bar of an exemplary pair of extended bars may extend between a respective proximal end of each extended bar of an exemplary pair of extended bars and a respective distal end of each extended bar of an exemplary pair of extended bars. A respective longitudinal axis of each extended bar of an exemplary pair of extended bars may be perpendicular to an exemplary top surface of an exemplary platform.

An exemplary mobility device may further include a pair of support assemblies. Each exemplary support assembly of the exemplary pair of support assemblies may be mounted on a respective side of an exemplary platform. An exemplary support assembly may include a first elongated segment that may be extended between a proximal end of the first elongated segment and a distal end of the first elongated segment. An exemplary proximal end of an exemplary first elongated segment may be pivotally coupled with an exemplary proximal end of a respective extended bar of an exemplary pair of extended bars. An exemplary support assembly may further include a second elongated segment that may be extended between a proximal end of an exemplary second elongated segment and a distal end of an exemplary second elongated segment. An exemplary proximal end of an exemplary second elongated segment may be pivotally coupled with an exemplary distal end of an exemplary first elongated segment. An exemplary support assembly may further include a third elongated segment that may be extended between a proximal end of an exemplary third elongated segment and a distal end of an exemplary third elongated segment. An exemplary proximal end of an exemplary third elongated segment may be pivotally coupled with an exemplary distal end of an exemplary second elongated segment.

An exemplary mobility device may further include a pair of leg attachment frames. Each exemplary leg attachment frame of an exemplary pair of leg attachment frames may be attached to an exemplary first elongated segment of each respective support assembly of an exemplary pair of support assemblies. Each exemplary leg attachment frame of an exemplary pair of leg attachment frames may be configured to secure a respective crus of a user to an exemplary first elongated segment of each respective support assembly of an exemplary pair of support assemblies.

An exemplary mobility device may further include a pair of thigh attachment frames. Each exemplary thigh attachment frame of an exemplary pair of thigh attachment frames may be attached to an exemplary second elongated segment of each respective support assembly of an exemplary pair of support assemblies. Each exemplary thigh attachment frame of an exemplary pair of thigh attachment frames may be configured to secure a respective thigh of the user to an exemplary second elongated segment of each respective support assembly of an exemplary pair of support assemblies.

An exemplary mobility device may further include a pair of hip support frames. Each exemplary hip support frame of an exemplary pair of hip support frames may be attached to an exemplary third elongated segment of each respective support assembly of an exemplary pair of support assemblies. An exemplary pair of hip support frames may be configured to support a hip of a user.

An exemplary mobility device may further include a pair of torso attachment frames. Each exemplary torso attachment frame of an exemplary pair of torso attachment frames may be attached to an exemplary distal end of an exemplary third elongated segment of each respective support assembly of an exemplary pair of support assemblies. An exemplary pair of torso attachment frames may be configured to support a torso of the user.

An exemplary mobility device may further include a pair of actuators. Each exemplary actuator of an exemplary pair of actuators may be coupled between an exemplary distal end of a respective extended bar of an exemplary pair of extended bars and an exemplary third elongated segment of a respective support assembly of an exemplary pair of support assemblies. An exemplary pair of actuators may be configured to drive pivotal movements of an exemplary pair of support assemblies.

BRIEF DESCRIPTION OF THE DRAWINGS

The novel features which are believed to be characteristic of the present disclosure, as to its structure, organization, use and method of operation, together with further objectives and advantages thereof, will be better understood from the following drawings in which a presently preferred embodiment of the present disclosure will now be illustrated by way of example. It is expressly understood, however, that the drawings are for illustration and description only and are not intended as a definition of the limits of the present disclosure. Embodiments of the present disclosure will now be described by way of example in association with the accompanying drawings in which.

DETAILED DESCRIPTION

The novel features which are believed to be characteristic of the present disclosure, as to its structure, organization, use and method of operation, together with further objectives and advantages thereof, will be better understood from the following discussion.

The present disclosure is directed to exemplary embodiments of an exemplary device for lifting, mobility, and rehabilitation of a user. In an exemplary embodiment, a mobility device and a method for utilizing a mobility device for improving and enhancing the mobility of a disabled user are disclosed.

An exemplary mobility device may allow a user to change their posture among sitting, lying, and standing positions. An exemplary mobility device may include support assemblies that may be secured to feet, legs, thighs, and torso of a user. An exemplary device may further include an actuator that may be coupled with the exemplary support assemblies and may actuate rotational movements of the exemplary support assemblies with respect to each other. Such movement of support assemblies may accordingly move respective limbs of a disabled user.

An exemplary mobility device may allow for a user to change position from a lying position to a standing position or from a standing position to a sitting position, which significantly increases mobility of a disabled user. An exemplary mobility device may further include an exemplary wheeled base that may allow a disabled user to further move around.

Figure 1:
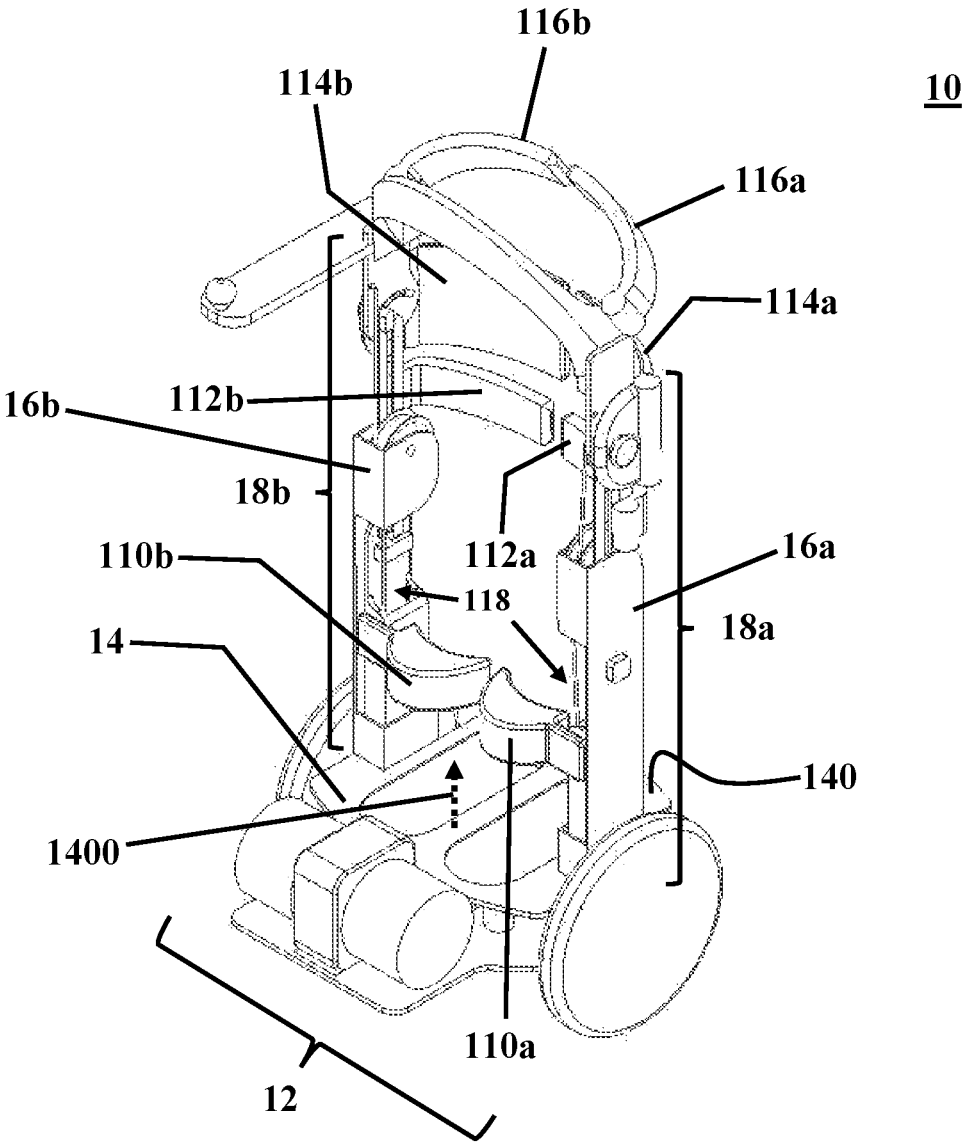
FIG. 1 illustrates a perspective view of a mobility device, consistent with one or more exemplary embodiments of the present disclosure.

FIG. 1 illustrates a perspective view of a mobility device 10, consistent with one or more exemplary embodiments of the present disclosure. In an exemplary embodiment, mobility device 10 may include a wheeled chassis 12, a platform 14 that may be mounted on wheeled chassis 12, a pair of extended bars (16*a*, 16*b*) that may be mounted on respective sides of platform 14, a pair of support assemblies (18*a*, 18*b*) that may be coupled with respective pair of extended bars (18*a*, 18*b*), a pair of leg attachment frames (110*a*, 110*b*) that may secure legs of a user to pair of support assemblies (18*a*, 18*b*), a pair of thigh attachment frames (112*a*, 112*b*), a pair of hip support frames (114*a*, 114*b*), a pair of torso attachment frames (118*a*, 118*b*), and an actuator 118 that may be coupled to pair of support assemblies (18*a*, 18*b*).

Figure 2:
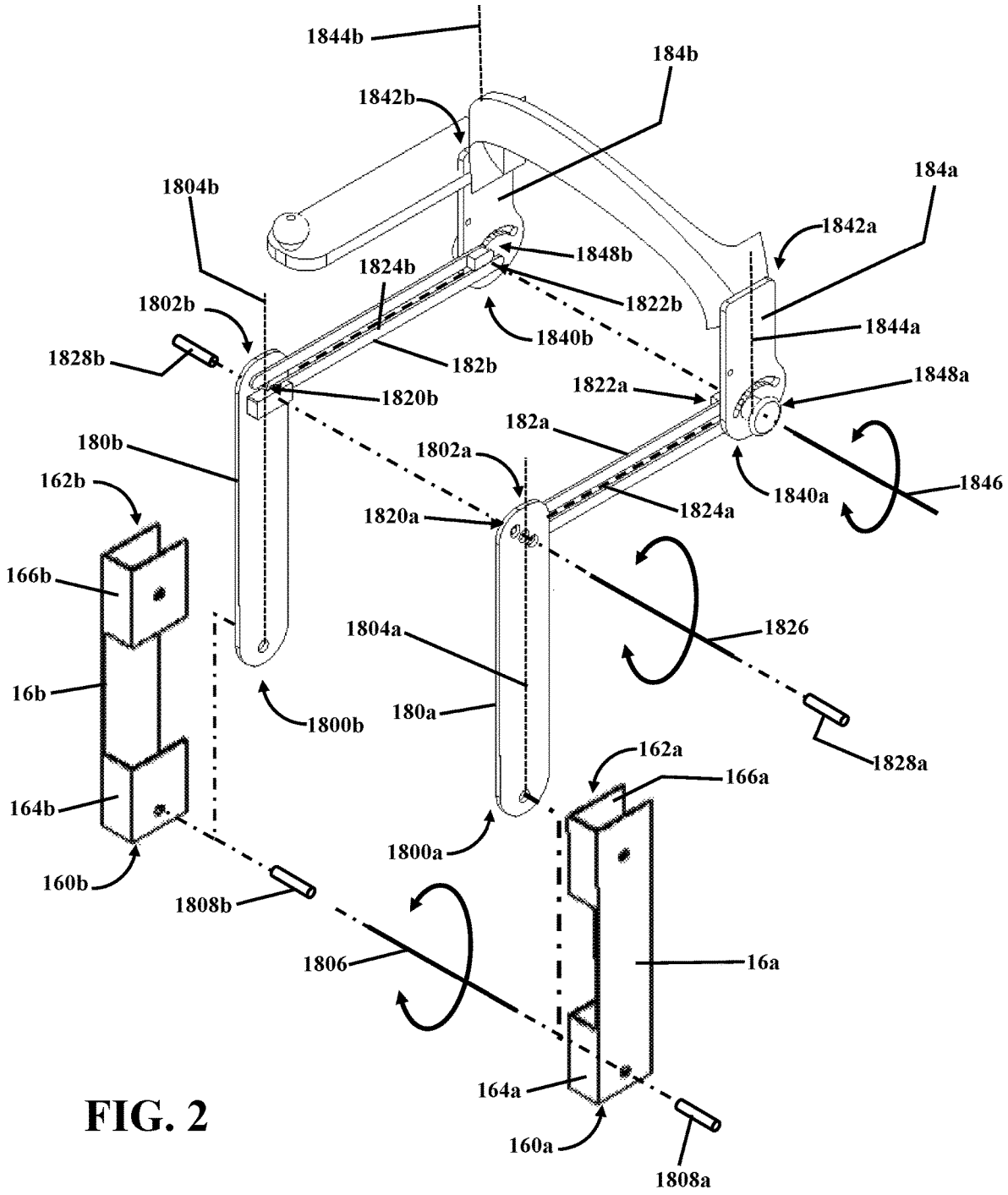
FIG. 2 illustrates an exploded view of extended bars and support assemblies of a mobility device, consistent with one or more exemplary embodiments of the present disclosure.
Figure 3:
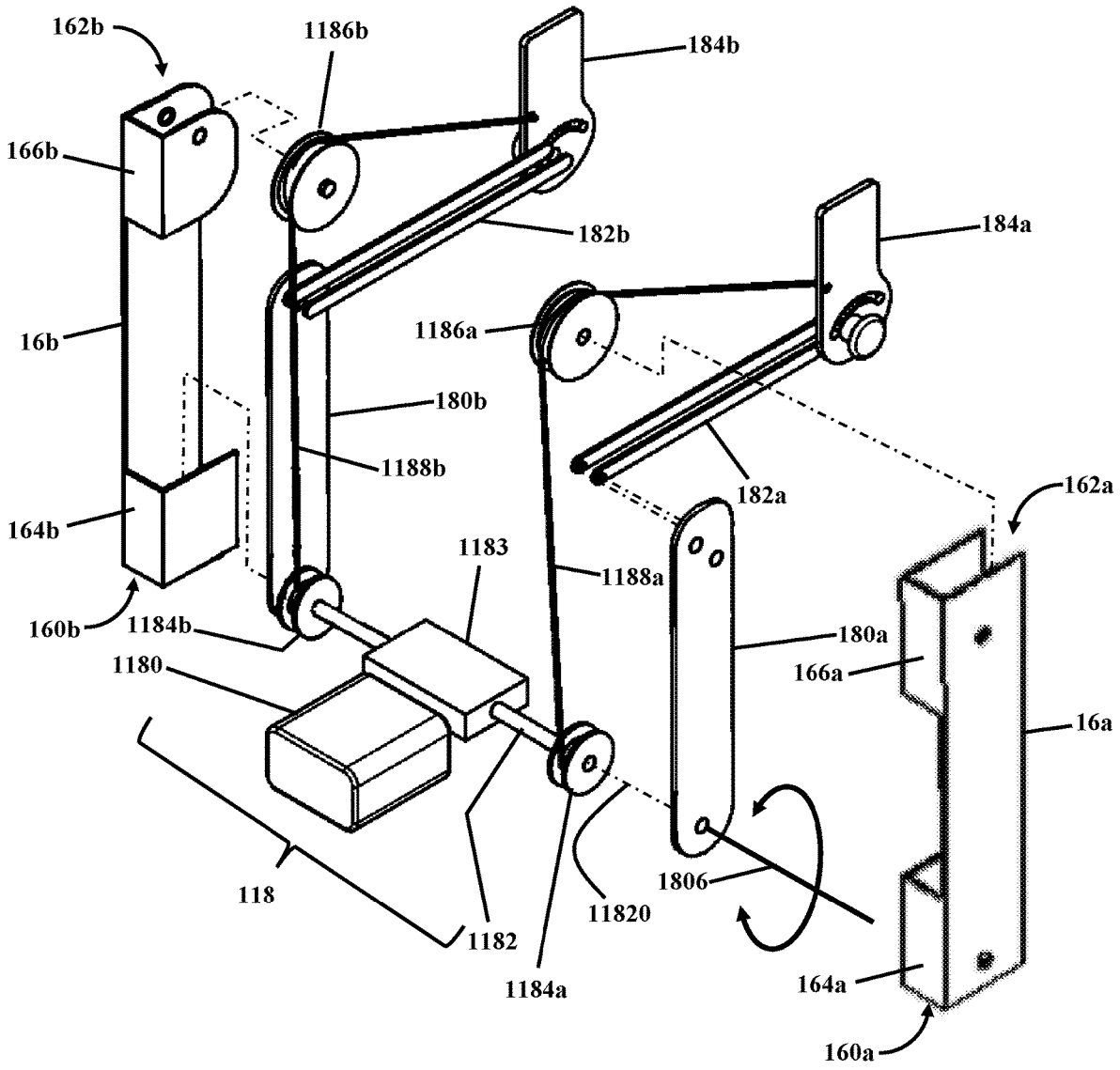
FIG. 3 illustrates extended bars, support assemblies, and an actuator of a mobility device, consistent with one or more exemplary embodiments of the present disclosure.

FIG. 2 illustrates an exploded view of extended bars (16*a*, 16*b*) and support assemblies (18*a*, 18*b*) of mobility device 10, consistent with one or more exemplary embodiments of the present disclosure. FIG. 3 illustrates extended bars (16*a*, 16*b*), support assemblies (18*a*, 18*b*), and actuator 118 of mobility device 10, consistent with one or more exemplary embodiments of the present disclosure.

In an exemplary embodiment, pair of extended bars (16*a*, 16*b*) may include a left extended bar 16*a* and a right extended bar 16*b* that may be structurally similar. Left extended bar 16*a* may be attached on a left side of platform 14 and right extended bar 16*b* may be mounted on a right side of platform 14. In an exemplary embodiment, left extended bar 16*a* may extend perpendicular to a top surface 140 of platform 14 between a proximal end 160*a* of left extended bar 16*a* and a distal end 162*a* of left extended bar 16*a*. In an exemplary embodiment, left extended bar 16*a* may include a left lower housing 164*a* at proximal end 160*a* and a left upper housing 166*a* at distal end 162*a* of left extended bar 16*a*. In an exemplary embodiment, right extended bar 16*b* may extend perpendicular to a top surface 140 of platform 14 between a proximal end 160*b* of right extended bar 16*b* and a distal end 162*b* of right extended bar 16*b*. In an exemplary embodiment, right extended bar 16*b* may include a right lower housing 164*b* at proximal end 160*b* and a right upper housing 166*b* at distal end 162*b* of right extended bar 16*b*.

In an exemplary embodiment, pair of support assemblies (18*a*, 18*b*) may include a left support assembly 18*a* and a right support assembly 18*b* that may be structurally similar. Left support assembly 18*a* may be mounted on a left side of platform 14 and right support assembly 18*b* may be mounted on a right side of platform 14. In an exemplary embodiment, left support assembly 18*a* may include a first left elongated segment 180*a* that may extend between a proximal end 1800*a* and a distal end 1802*a* along a longitudinal axis 1804*a* of first left elongated segment 180*a*. In an exemplary embodiment, proximal end 1800*a* of first left elongated segment 180*a* may be housed within and pivotally coupled to left lower housing 164*a* of left extended bar 16*a*, which may allow for first left elongated segment 180*a* to pivot about a first pivot axis 1806 at proximal end 1800*a* relative to a top surface 140 of platform 14. In an exemplary embodiment, first pivot axis 1806 may be perpendicular to a normal axis 1400 of top surface 140 of platform 14. Normal axis 1400 is an axis perpendicular to top surface 140. In an exemplary embodiment, first left elongated segment 180*a* may pivot about first pivot axis 1806 such that an angle between longitudinal axis 1804*a* of first left elongated segment 180*a* and normal axis 1400 may change between 0° and 90°. In an exemplary embodiment, first left elongated segment 180*a* may be pivotally coupled to left lower housing 164*a* of left extended bar 16*a* utilizing a first left revolute joint 1808*a* that may be a single-axis pin joint capable of rotating about first pivot axis 1806.

In an exemplary embodiment, left support assembly 18*a* may further include a second left elongated segment 182*a* that may extend between a proximal end 1820*a* and a distal end 1822*a* along a longitudinal axis 1824*a* of second left elongated segment 182*a*. In an exemplary embodiment, proximal end 1820*a* of second left elongated segment 182*a* may be pivotally coupled with distal end 1802*a* of first left elongated segment 180*a*, which may allow for second left elongated segment 182*a* to pivot about a second pivot axis 1826 at proximal end 1820*a* relative to first left elongated segment 180*a*. In an exemplary embodiment, second pivot axis 1826 may be perpendicular to normal axis 1400. In an exemplary embodiment, second left elongated segment 182*a* may pivot about second pivot axis 1826 such that an angle between longitudinal axis 1824*a* of second left elongated segment 182*a* and longitudinal axis 1804*a* of first left elongated segment 180*a* may change between 0° and 90°. In an exemplary embodiment, second left elongated segment 182*a* may be pivotally coupled to first left elongated segment 180*a* utilizing a second left revolute joint 1828*a* that may be a single-axis pin joint capable of rotating about second pivot axis 1826.

In an exemplary embodiment, left support assembly 18*a* may further include a third left elongated segment 184*a* that may extend between a proximal end 1840*a* and a distal end 1842*a* along a longitudinal axis 1844*a* of third left elongated segment 184*a*. In an exemplary embodiment, proximal end 1840*a* of third left elongated segment 184*a* may be pivotally coupled with distal end 1842*a* of second left elongated segment 182*a*, which may allow for third left elongated segment 184*a* to pivot about a third pivot axis 1846 at proximal end 1840*a* relative to second left elongated segment 182*a*. In an exemplary embodiment, third pivot axis 1846 may be perpendicular to normal axis 1400. In an exemplary embodiment, third left elongated segment 184*a* may pivot about third pivot axis 1846 such that an angle between longitudinal axis 1844*a* of third left elongated segment 184*a* and longitudinal axis 1824*a* of second left elongated segment 182*a* may change between 0° and 90°. In an exemplary embodiment, third left elongated segment 184*a* may be pivotally coupled to second left elongated segment 182*a* utilizing a third left revolute joint 1848*a* that may be a single-axis pin joint capable of rotating about third pivot axis 1846.

In an exemplary embodiment, right support assembly 18*b* may include a first right elongated segment 180*b* that may extend between a proximal end 1800*b* and a distal end 1802*b* along a longitudinal axis 1804*b* of first right elongated segment 180*b*. In an exemplary embodiment, proximal end 1800*b* of first right elongated segment 180*b* may be housed within and pivotally coupled to right lower housing 164*b* of right extended bar 16*a*, which may allow for first right elongated segment 180*b* to pivot about a first pivot axis 1806 at proximal end 1800*b* relative to a top surface 140 of platform 14. In an exemplary embodiment, first pivot axis 1806 may be perpendicular to a normal axis 1400 of top surface 140 of platform 14. Normal axis 1400 is an axis perpendicular to top surface 140. In an exemplary embodiment, first right elongated segment 180*b* may pivot about first pivot axis 1806 such that an angle between longitudinal axis 1804*b* of first right elongated segment 180*b* and normal axis 1400 may change between 0° and 90°. In an exemplary embodiment, first right elongated segment 180*b* may be pivotally coupled to right lower housing 164*b* of right extended bar 16*b* utilizing a first right revolute joint 1808*b* that may be a single-axis pin joint capable of rotating about first pivot axis 1806.

In an exemplary embodiment, right support assembly 18*b* may further include a second right elongated segment 182*b* that may extend between a proximal end 1820*b* and a distal end 1822*b* along a longitudinal axis 1824*b* of second right elongated segment 182*b*. In an exemplary embodiment, proximal end 1820*b* of second right elongated segment 182*b* may be pivotally coupled with distal end 1802*b* of first right elongated segment 180*a*, which may allow for second right elongated segment 182*b* to pivot about a second pivot axis 1826 at proximal end 1820*b* relative to first right elongated segment 180*b*. In an exemplary embodiment, second pivot axis 1826 may be perpendicular to normal axis 1400. In an exemplary embodiment, second right elongated segment 182*b* may pivot about second pivot axis 1826 such that an angle between longitudinal axis 1824*b* of second right elongated segment 182*b* and longitudinal axis 1804*b* of first right elongated segment 180*b* may change between 0° and 90°. In an exemplary embodiment, second right elongated segment 182*b* may be pivotally coupled to first right elongated segment 180*b* utilizing a second right revolute joint 1828*b* that may be a single-axis pin joint capable of rotating about second pivot axis 1826.

In an exemplary embodiment, right support assembly 18*b* may further include a third right elongated segment 184*b* that may extend between a proximal end 1840*b* and a distal end 1842*b* along a longitudinal axis 1844*b* of third right elongated segment 184*b*. In an exemplary embodiment, proximal end 1840*b* of third right elongated segment 184*b* may be pivotally coupled with distal end 1842*a* of second right elongated segment 182*b*, which may allow for third right elongated segment 184*b* to pivot about a third pivot axis 1846 at proximal end 1840*b* relative to second right elongated segment 182*b*. In an exemplary embodiment, third pivot axis 1846 may be perpendicular to normal axis 1400. In an exemplary embodiment, third right elongated segment 184*b* may pivot about third pivot axis 1846 such that an angle between longitudinal axis 1844*b* of third right elongated segment 184*b* and longitudinal axis 1824*b* of second right elongated segment 182*b* may change between 0° and 90°. In an exemplary embodiment, third right elongated segment 184*b* may be pivotally coupled to second right elongated segment 182*b* utilizing a third right revolute joint 1848*b* that may be a single-axis pin joint capable of rotating about third pivot axis 1846.

In an exemplary embodiment, actuator 118 may include a motor 1180, a first shaft 1182 that may be coupled to motor 1180 via a first differential 1183. In an exemplary embodiment, motor 1180 may be configured to drive a rotational movement of first shaft 1182 about a longitudinal axis 11820 of first shaft 1182. In an exemplary embodiment, longitudinal axis 11820 of first shaft 1182 may coincide with first pivot axis 1806. In an exemplary embodiment, first shaft 1182 may extend out of first differential 1182 at either side of first differential 1182. In an exemplary embodiment, motor 1180 may include an electric motor, however, other fuel-powered motors may further be utilized instead of an electric motor.

In an exemplary embodiment, actuator 118 may further include a left rotating pulley 1184*a* that may be coupled to a first end of first shaft 1182 and a right rotating pulley 1184*b* that may be coupled to an opposing second end of first shaft 1182. In an exemplary embodiment, left rotating pulley 1184*a* may further be coupled to proximal end 160*a* of left extended bar 16*a* and may be housed within left lower housing 164*a*. In an exemplary embodiment, right rotating pulley 1184*b* may further be coupled to proximal end 160*b* of right extended bar 16*b* and may be housed within right lower housing 164*b*.

In an exemplary embodiment, actuator 118 may further include a left idler pulley 1186*a* that may be coupled to distal end 162*a* of left extended bar 16*a* and a right idler pulley 1186*b* that may be coupled to distal end 162*b* of right extended bar 16*b*. In an exemplary embodiment, left idler pulley 1186*a* may be housed within left upper housing 166*a* and right idler pulley 1186*b* may be housed within right upper housing 166*b*. In an exemplary embodiment, actuator 118 may further include drive elements, such as left-side cable 1188*a* that may be coupled from a first end of left-side cable 1188*a* to left rotating pulley 1184*a* and may be attached from a second opposing end of left-side cable 1188*a* to third left elongated segment 184*a*. In an exemplary embodiment, left-side cable 1188*a* being coupled with left rotating pulley 1184*a* may refer to left-side cable 1188*a* being attached to and capable of being wound around left rotating pulley 1184*a*. Left-side cable 1188*a* may be extended upward from left rotating pulley 1184*a* along longitudinal axis of left extended bar 16*a* toward left idler pulley 1186*a*. Left-side cable 1188*a* may go around left idler pulley 1186*a* and then may be attached to third left elongated segment 184*a*. In an exemplary embodiment, left rotating pulley 1184*a* may transfer the rotational movement of first shaft 1182 to left-side cable 1188*a*, while left idler pulley 1186*a* may support the movement and change the direction of left-side cable 1188*a*. Such arrangement of left rotating pulley 1184*a*, left idler pulley 1186*a*, and left-side cable 1188*a* may allow for transferring the power of motor to third left elongated segment 184*a* to selectively actuate rotational and translational movements of third left elongated segment 184*a*.

In an exemplary embodiment, actuator 118 may further include drive elements, such as right-side cable 1188*b* that may be coupled from a first end of right-side cable 1188*b* to right rotating pulley 1184*b* and may be attached from a second opposing end of right-side cable 1188*b* to third right elongated segment 184*b*. In an exemplary embodiment, right-side cable 1188*b* being coupled with right rotating pulley 1184*b* may refer to right-side cable 1188*b* being attached to and capable of being wound around right rotating pulley 1184*b*. Right-side cable 1188*b* may be extended upward from right rotating pulley 1184*b* along longitudinal axis of right extended bar 16*b* toward right idler pulley 1186*b*. Right-side cable 1188*b* may go around right idler pulley 1186*b* and then may be attached to third right elongated segment 184*b*. In an exemplary embodiment, right rotating pulley 1184*b* may transfer the rotational movement of first shaft 1182 to right-side cable 1188*b*, while right idler pulley 1186*b* may support the movement and change the direction of right-side cable 1188*b*. Such arrangement of right rotating pulley 1184*b*, right idler pulley 1186*b*, and right-side cable 1188*b* may allow for transferring the power of motor to third right elongated segment 184*b* to selectively actuate rotational and translational movements of third right elongated segment 184*b*.

Figure 4A:
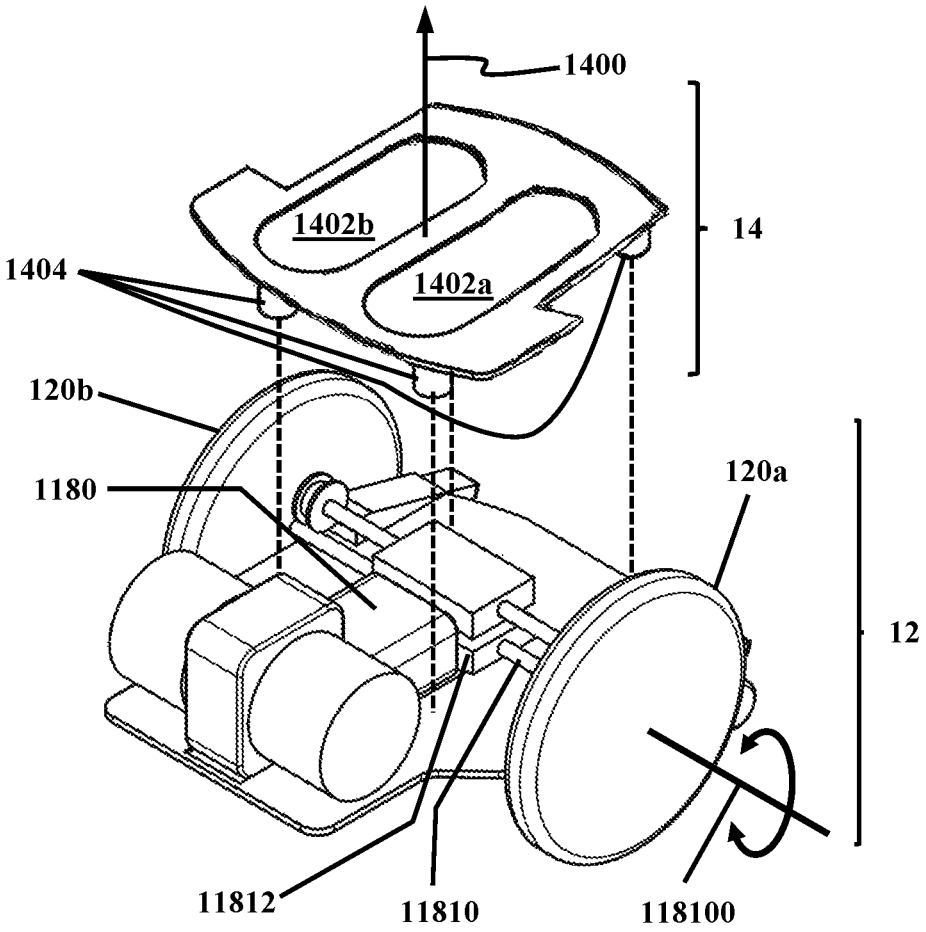
FIG. 4A illustrates an exploded perspective front view of a platform and a wheeled chassis of a mobility device, consistent with one or more exemplary embodiments of the present disclosure.
Figure 4B:
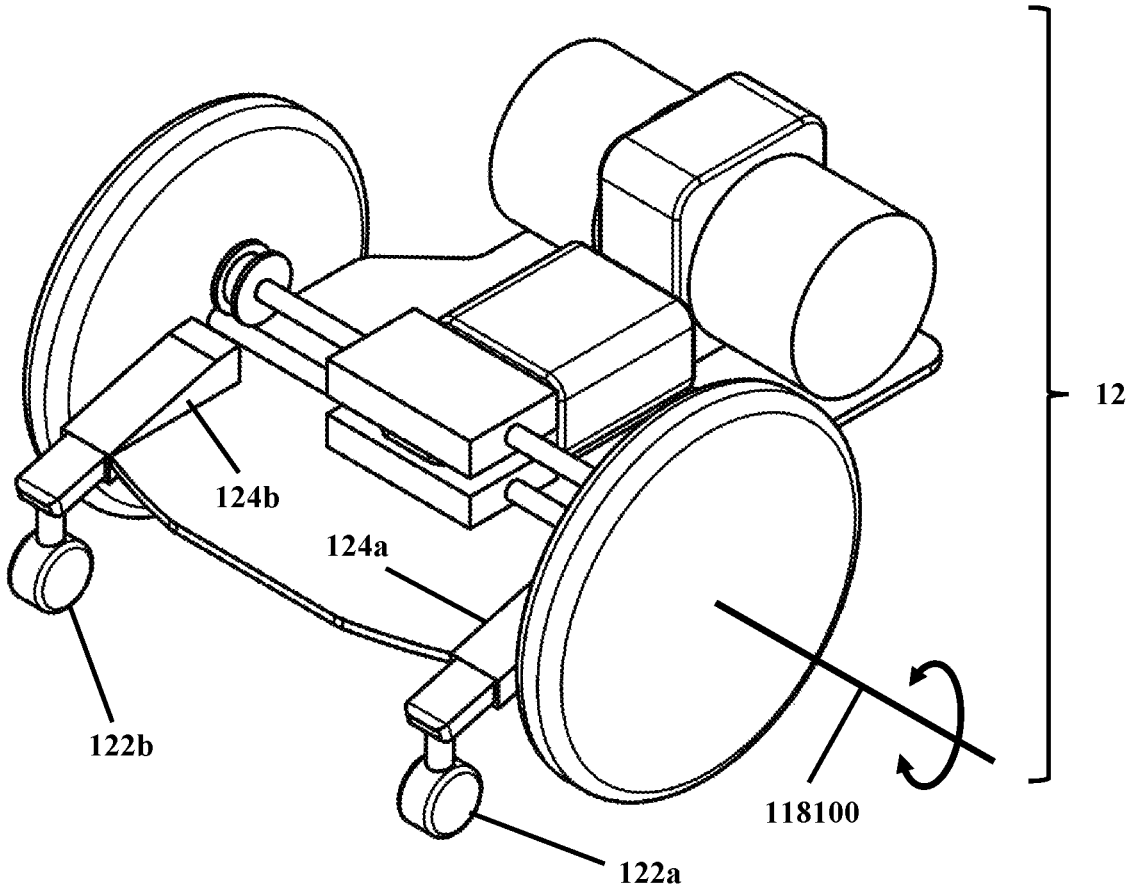
FIG. 4B illustrates an exploded perspective front view of wheeled chassis, consistent with one or more exemplary embodiments of the present disclosure.

FIG. 4A illustrates an exploded perspective front view of platform 14 and wheeled chassis 12 of mobility device 10, consistent with one or more exemplary embodiments of the present disclosure. FIG. 4B illustrates an exploded perspective front view of wheeled chassis 12, consistent with one or more exemplary embodiments of the present disclosure.

In an exemplary embodiment, top surface 140 of platform 14 may be configured to support a user's feet. For example, top surface 140 may include two recessed portions (1402*a*, 1402*b*) corresponding to each foot of a user, such that, each foot of a user may rest upon each respective recessed portion of recessed portions (1402*a*, 1402*b*). In an exemplary embodiment, platform 14 may be mounted on wheeled chassis 12 either directly or via support legs 1404.

In an exemplary embodiment, wheeled chassis 12 may include a pair of rotating wheels (120*a*, 120*b*), where each rotating wheel of pair of rotating wheels (120*a*, 120*b*) may be mounted at a respective side of wheeled chassis 12. In an exemplary embodiment, each rotating wheel of pair of rotating wheels (120*a*, 120*b*) may be coupled with motor 1180 via a second shaft 11810 and motor 1180 may further be configured to drive a rotational movement of pair of rotating wheels (120*a*, 120*b*) about a longitudinal axis 118100 of second shaft 11810. The power of motor 1180 may further be transferred to second shaft 11810 via a second differential 11812. In an exemplary embodiment, longitudinal axis 118100 of second shaft 11810 may be parallel with first pivot axis 1806. In an exemplary embodiment, second shaft 1182 may extend out of second differential 11812 at either side of second differential 11812. In an exemplary embodiment, pair of rotating wheels (120*a*, 120*b*) may include a left rotating wheel 120*a* that may be coupled with a first end of second shaft 11810 and a right rotating wheel 120*b* that may be coupled with an opposing second end of second shaft 11810. In an exemplary embodiment, wheeled chassis 12 may include a pair of idle wheels (122*a*, 122*b*), where each idle wheel of pair of idle wheels (122*a*, 122*b*) may be mounted at a respective side of wheeled chassis 12. In an exemplary embodiment, each idle wheel of pair of idle wheels (122*a*, 122*b*) may be mounted at a distal end of a respective support rod of a pair of support rods (124*a*, 124*b*).

In an exemplary embodiment, pair of rotating wheels (120*a*, 120*b*) may have a larger diameter than pair of idle wheels (122*a*, 122*b*). In an exemplary embodiment, pair of idle wheels (122*a*, 122*b*) may include a pair of caster wheels that may be undriven and capable of rotating and swivel. As mentioned before, in exemplary embodiments, rotating wheels (120*a*, 120*b*) and idle wheels (122*a*, 122*b*) may be utilized for driving around wheeled chassis 12 and either pair of rotating wheels (120*a*, 120*b*) or idle wheels (122*a*, 122*b*) may be controllable by a steering stick or other similar form of control. For example, for forward and backward translational movements of wheeled chassis 12, an exemplary steering stick or controller may selectively urge motor 1180 to drive rotational movements of rotating wheels (120*a*, 120*b*) either in a forward direction or a backward direction. Furthermore, in an exemplary embodiment, rotating wheels (120*a*, 120*b*) may rotate simultaneously or individually such as to permit forward, rearward, or zero-radius turning of wheeled chassis 12. In other words, for performing a zero-radius turning of wheeled chassis 12, an exemplary steering stick or controller may selectively urge motor 1180 to individually drive a rotational movement of either one of rotating wheels (120*a*, 120*b*).

In an exemplary embodiment, each support rod of a pair of support rods (124*a*, 124*b*) may be attached to wheeled chassis 12 and may be extended perpendicular to both longitudinal axis 118100 of second shaft 11810 and normal axis 1400. In an exemplary embodiment, each support rod of a pair of support rods (124*a*, 124*b*) may include a telescopic rod that may allow a length of each support rod of pair of support rods (124*a*, 124*b*) to be individually adjusted.

Figure 5A:
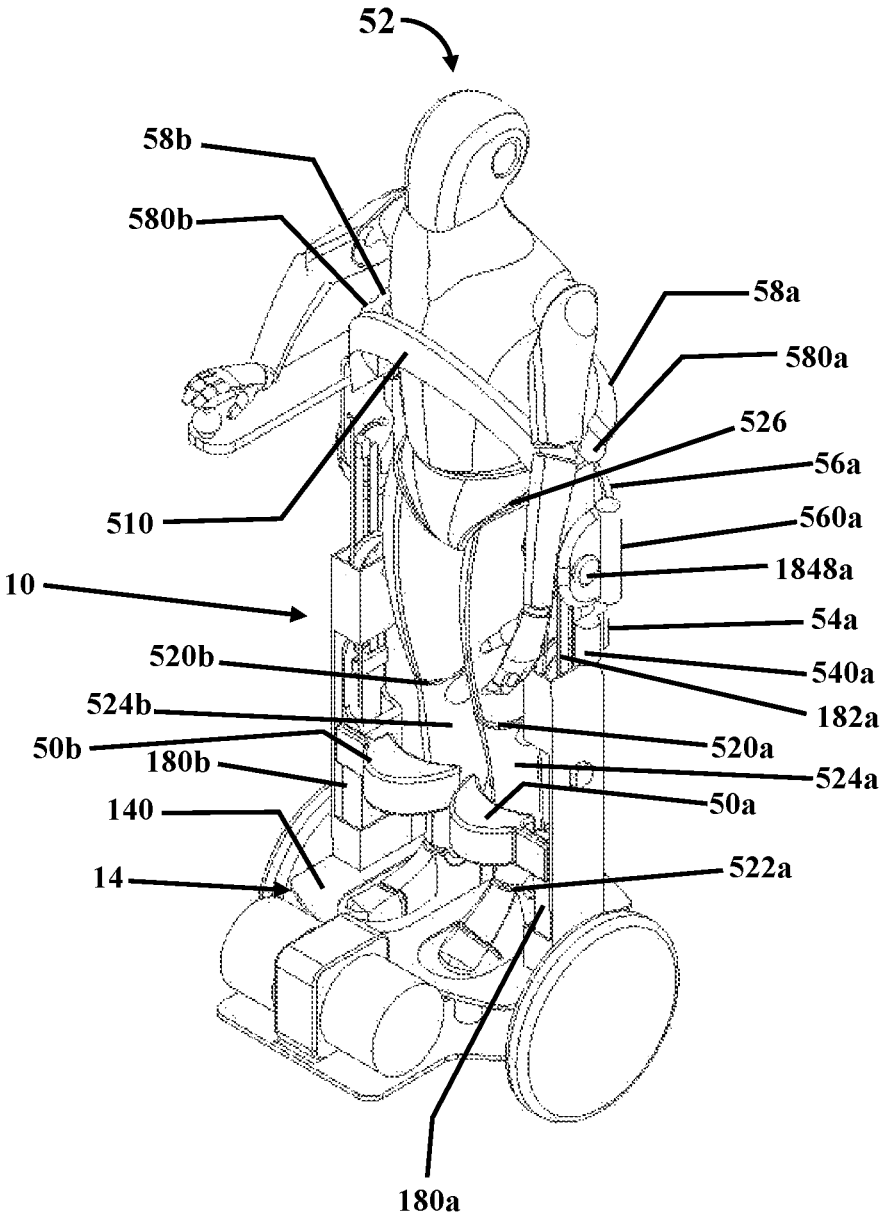
FIG. 5A illustrates a front perspective view of a mobility device in a standing position, consistent with one or more exemplary embodiments of the present disclosure.
Figure 5B:
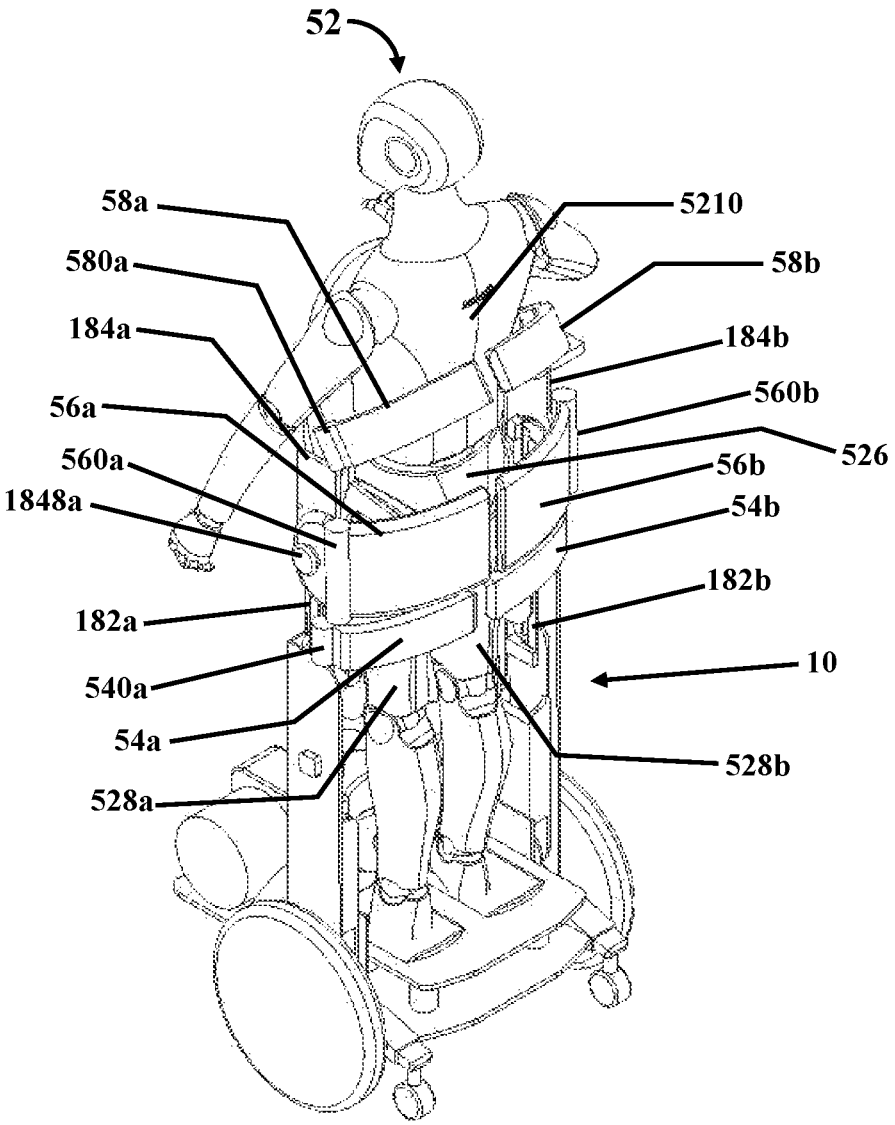
FIG. 5B illustrates a rear perspective view of a mobility device in a standing position, consistent with one or more exemplary embodiments of the present disclosure.

FIG. 5A illustrates a front perspective view of mobility device 10 in a standing position, consistent with one or more exemplary embodiments of the present disclosure. FIG. 5B illustrates a rear perspective view of mobility device 10 in a standing position, consistent with one or more exemplary embodiments of the present disclosure.

In an exemplary embodiment, mobility device 10 may further include a left leg attachment frame 50*a* that may be attached to first left elongated segment 180*a* and a right leg attachment frame 50*b* that may be attached to first right elongated segment 180*b*. In an exemplary embodiment, left leg attachment frame 50*a* may include a curved frame that may be attached to first left elongated segment 180*a* at a predetermined height from top surface 140 such that when a user 52 may stand on top surface 140 of platform 140, left leg attachment frame 50*a* may be positioned between a left knee 520*a* and a left ankle 522*a* of user 52. In other words, left leg attachment frame 50*a* may be positioned on a left crus 524*a* of user 52. In an exemplary embodiment, left leg attachment frame 50*a* may be configured to secure left crus 524*a* of user 52 to first left elongated segment 180*a* such that any rotational or translational movement of left crus 524*a* of user 52 with respect to first left elongated segment 180*a* may be restrained. In an exemplary embodiment, left leg attachment frame 50*a* including a curved frame may refer to left leg attachment frame 50*a* being bent to have a curvature as seen cross sectionally when viewed with a plane perpendicular to normal axis 1400 as the plan view plane. In other words, in an exemplary embodiment, when user 52 stands on top surface 140 of platform 140, and left leg attachment frame 50*a* is secured to left crus 524*a* of user 52, left leg attachment frame 50*a* is curved such that left leg attachment frame 50*a* may surround a front portion of left crus 524*a* of user 52. In an exemplary embodiment, a strap or other similar fastening members may further be utilized to secure left crus 524*a* of user 52 to left leg attachment frame 50*a*.

In an exemplary embodiment, right leg attachment frame 50*b* may include a curved frame that may be attached to first right elongated segment 180*b* at a predetermined height from top surface 140 such that when a user 52 may stand on top surface 140 of platform 140, right leg attachment frame 50*a* may be positioned between a right knee 520*b* and a right ankle 522*b* of user 52. In other words, right leg attachment frame 50*b* may be positioned on a right crus 524*b* of user 52. In an exemplary embodiment, right leg attachment frame 50*b* may be configured to secure right crus 524*b* of user 52 to first right elongated segment 180*b* such that any rotational or translational movement of right crus 524*b* of user 52 with respect to first right elongated segment 180*b* may be restrained. In an exemplary embodiment, right leg attachment frame 50*b* including a curved frame may refer to right leg attachment frame 50*b* being bent to have a curvature as seen cross sectionally when viewed with a plane perpendicular to normal axis 1400 as the plan view plane. In other words, in an exemplary embodiment, when user 52 stands on top surface 140 of platform 140, and right leg attachment frame 50*b* is secured to right crus 524*b* of user 52, right leg attachment frame 50*b* is curved such that right leg attachment frame 50*b* may surround a front portion of right crus 524*b* of user 52. In an exemplary embodiment, a strap or other similar fastening members may further be utilized to secure right crus 524*b* of user 52 to right leg attachment frame 50*b*.

In an exemplary embodiment, mobility device 10 may further include a left thigh attachment frame 54*a* that may be attached to second left elongated segment 182*a* and a right thigh attachment frame 54*b* that may be attached to second right elongated segment 182*b*. In an exemplary embodiment, left thigh attachment frame 54*a* may include a curved frame that may be attached to second left elongated segment 182*a*, such that when user 52 may stand on top surface 140 of platform 140, left thigh attachment frame 54*a* may be positioned between left knee 520*a* and a hip 526 of user 52. In other words, left thigh attachment frame 54*a* may be positioned on a left thigh 528*a* of user 52. In an exemplary embodiment, left thigh attachment frame 54*a* may be configured to secure left thigh 528*a* of user 52 to second left elongated segment 182*a* such that any rotational or translational movement of left thigh 528*a* of user 52 may be restrained with respect to second left elongated segment 182*a*. In an exemplary embodiment, left thigh attachment frame 54*a* may be pivotally coupled with second left elongated segment 182*a* via a first left pin joint 540*a* that may allow left thigh attachment frame 54*a* to pivot about an axis parallel with longitudinal axis 1824*a* of second left elongated segment 182*a*. Such pivotable arrangement of left thigh attachment frame 54*a* may allow for pivoting left thigh attachment frame 54*a* between an opened position where left thigh attachment frame 54*a* may be rotated away from user 52 and a closed position, where left thigh attachment frame 54*a* may be positioned behind left thigh 528*a* of user 52.

In an exemplary embodiment, right thigh attachment frame 54*b* may include a curved frame that may be attached to second right elongated segment 182*b*, such that when user 52 may stand on top surface 140 of platform 140, right thigh attachment frame 54*b* may be positioned between right knee 520*b* and a hip 526 of user 52. In other words, right thigh attachment frame 54*b* may be positioned on a right thigh 528*b* of user 52. In an exemplary embodiment, right thigh attachment frame 54*b* may be configured to secure right thigh 528*b* of user 52 to second right elongated segment 182*b* such that any rotational or translational movement of right thigh 528*b* of user 52 may be restrained with respect to second right elongated segment 182*b*. In an exemplary embodiment, right thigh attachment frame 54*b* may be pivotally coupled with second right elongated segment 182*b* via a first right pin joint (not illustrated) that may allow right thigh attachment frame 54*b* to pivot about an axis parallel with longitudinal axis 1824*b* of second right elongated segment 182*b*. Such pivotable arrangement of right thigh attachment frame 54*b* may allow for pivoting right thigh attachment frame 54*b* between an opened position where right thigh attachment frame 54*b* may be rotated away from user 52 and a closed position, where right thigh attachment frame 54*b* may be positioned behind left thigh 528*b* of user 52.

In an exemplary embodiment, mobility device 10 may further include a left hip attachment frame 56*a* that may be attached to distal end 1822*a* of second left elongated segment 182*a* and proximal end 1840*a* of third left elongated segment 184*a*, and a right hip attachment frame 56*b* that may be attached to distal end 1822*b* of second right elongated segment 182*b* and proximal end 1840*b* of third right elongated segment 184*b*. In an exemplary embodiment, left hip attachment frame 56*a* may include a curved frame that may be attached to distal end 1822*a* of second left elongated segment 182*a* and proximal end 1840*a* of third left elongated segment 184*a*, such that when user 52 may stand on top surface 140 of platform 140, left hip attachment frame 56*a* may be positioned behind hip 526 of user 52. In other words, a left side of hip 526 of user 52 may rest upon left hip attachment frame 56*a*. In an exemplary embodiment, left hip attachment frame 56*a* may be pivotally coupled with third left revolute joint 1848*a* via a second left pin joint 560*a* that may allow left hip attachment frame 56*a* to pivot about an axis parallel with longitudinal axis 1824*a* of second left elongated segment 182*a*. Such pivotable arrangement of left hip attachment frame 56*a* may allow for pivoting left hip attachment frame 56*a* between an opened position where left hip attachment frame 56*a* may be rotated away from user 52 and a closed position, where left hip attachment frame 56*a* may be positioned behind hip 526 of user 52.

In an exemplary embodiment, right hip attachment frame 56*b* may include a curved frame that may be attached to distal end 1822*b* of second right elongated segment 182*b* and proximal end 1840*b* of third right elongated segment 184*b*, such that when user 52 may stand on top surface 140 of platform 140, right hip attachment frame 56*b* may be positioned behind hip 526 of user 52. In other words, a right side of hip 526 of user 52 may rest upon right hip attachment frame 56*b*. In an exemplary embodiment, right hip attachment frame 56*b* may be pivotally coupled with third right revolute joint 1848*b* via a second right pin joint 560*b* that may allow right hip attachment frame 56*b* to pivot about an axis parallel with longitudinal axis 1824*b* of second right elongated segment 182*b*. Such pivotable arrangement of right hip attachment frame 56*b* may allow for pivoting right hip attachment frame 56*b* between an opened position where right hip attachment frame 56*b* may be rotated away from user 52 and a closed position, where right hip attachment frame 56*b* may be positioned behind hip 526 of user 52.

In an exemplary embodiment, mobility device 10 may further include a left torso attachment frame 58*a* that may be coupled to distal end 1842*a* of third left elongated segment 184*a* and a right torso attachment frame 58*b* that may be coupled with distal end 1842*a* of third right elongated segment 184*a*. In an exemplary embodiment, left torso attachment frame 58*a* may include a curved frame that may be pivotally attached to distal end 1842*a* of third left elongated segment 184*a* via a third left pin joint 580*a*. In an exemplary embodiment, left torso attachment frame 58*a* may be positioned behind a left side of a torso 5210 of user 52 and may be configured to support torso 5210 of user 52 such that any rotational and translational movement of torso 5210 may be restrained with respect to third left elongated segment 184*a*. In an exemplary embodiment, left torso attachment frame 58*a* may be pivoted from a closed position where left torso attachment frame 58*a* may be positioned behind left side of torso 5210 of user 52 to an opened position where left torso attachment frame 58*a* may be moved away from torso 5210 of user 52.

In an exemplary embodiment, right torso attachment frame 58*b* may include a curved frame that may be pivotally attached to distal end 1842*b* of third right elongated segment 184*b* via a third right pin joint 580*b*. In an exemplary embodiment, right torso attachment frame 58*b* may be positioned behind a right side of a torso 5210 of user 52 and may be configured to support torso 5210 of user 52 such that any rotational and translational movement of torso 5210 may be restrained with respect to third right elongated segment 184*b*. In an exemplary embodiment, right torso attachment frame 58*b* may be pivoted from a closed position where right torso attachment frame 58*b* may be positioned behind right side of torso 5210 of user 52 to an opened position where right torso attachment frame 58*b* may be moved away from torso 5210 of user 52. In an exemplary embodiment, mobility device 10 may further include a curved chest support frame 510 that may be attached between distal end 1842*a* of third left elongated segment 184*a* and distal end 1842*b* of third right elongated segment 184*b*.

According to one or more exemplary embodiments, the present disclosure is further directed to a method for enhancing the mobility of a user. An exemplary method for enhancing the mobility of a user may utilize a mobility device such as mobility device 10 to allow a disabled user to change position and orientation among a lying position, a sitting position, and a standing position, while allowing the user to move around.

Figure 6A:
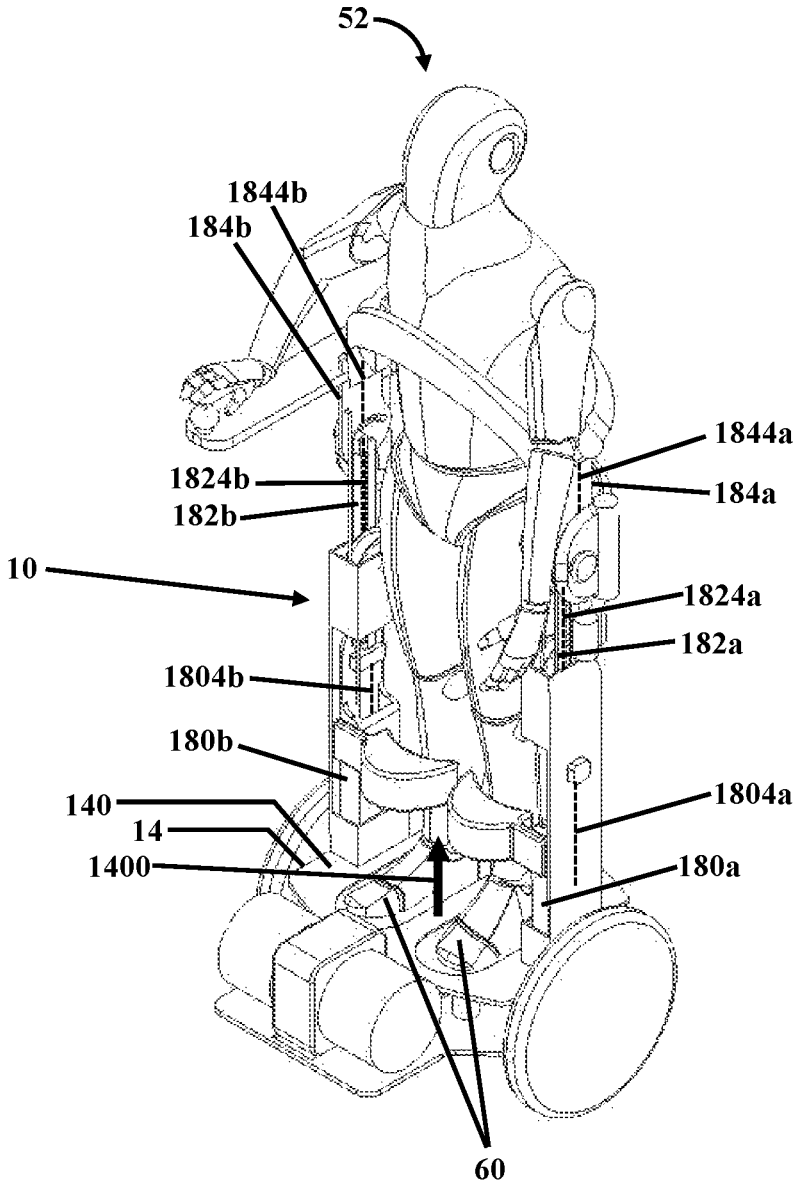
FIG. 6A illustrates a mobility device in a standing configuration, consistent with one or more exemplary embodiments of the present disclosure.
Figure 6B:
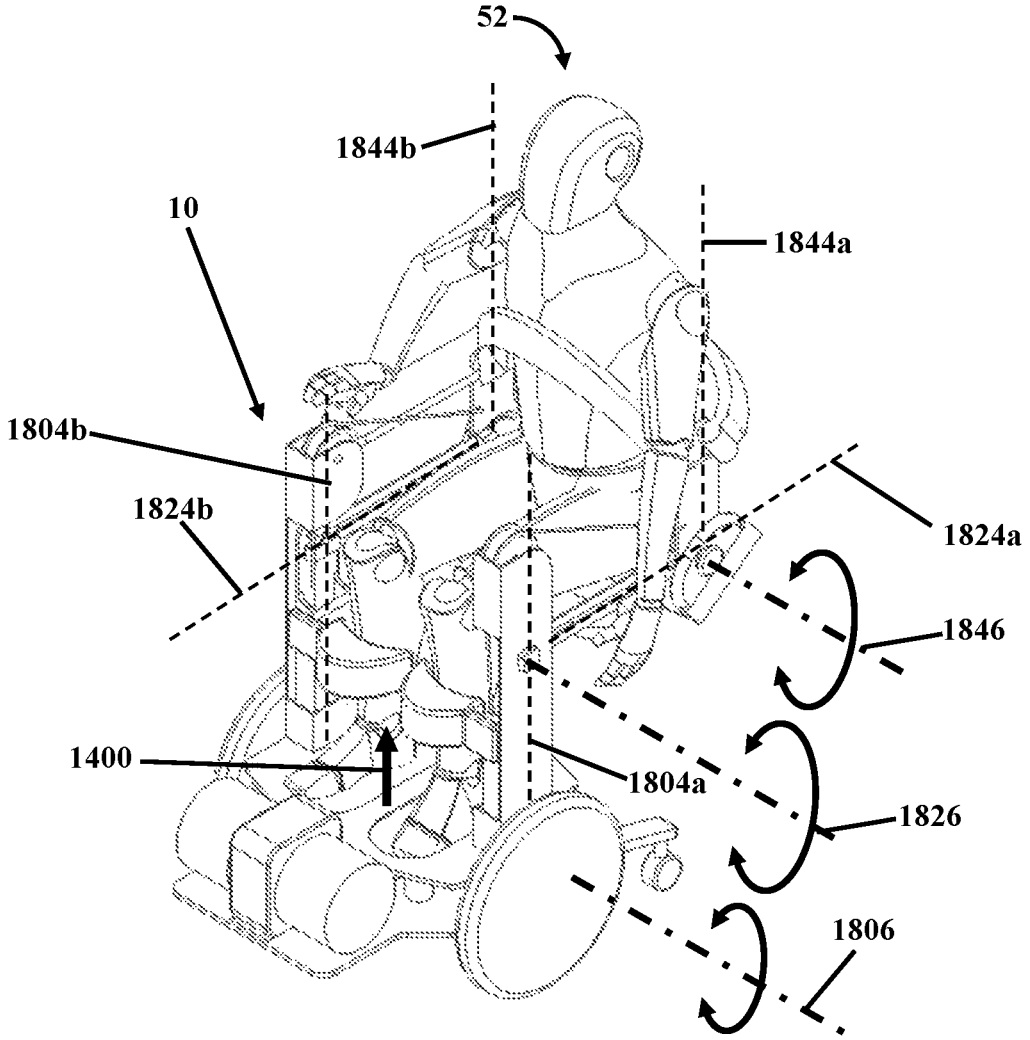
FIG. 6B illustrates a mobility device in a sitting configuration, consistent with one or more exemplary embodiments of the present disclosure.
Figure 6C:
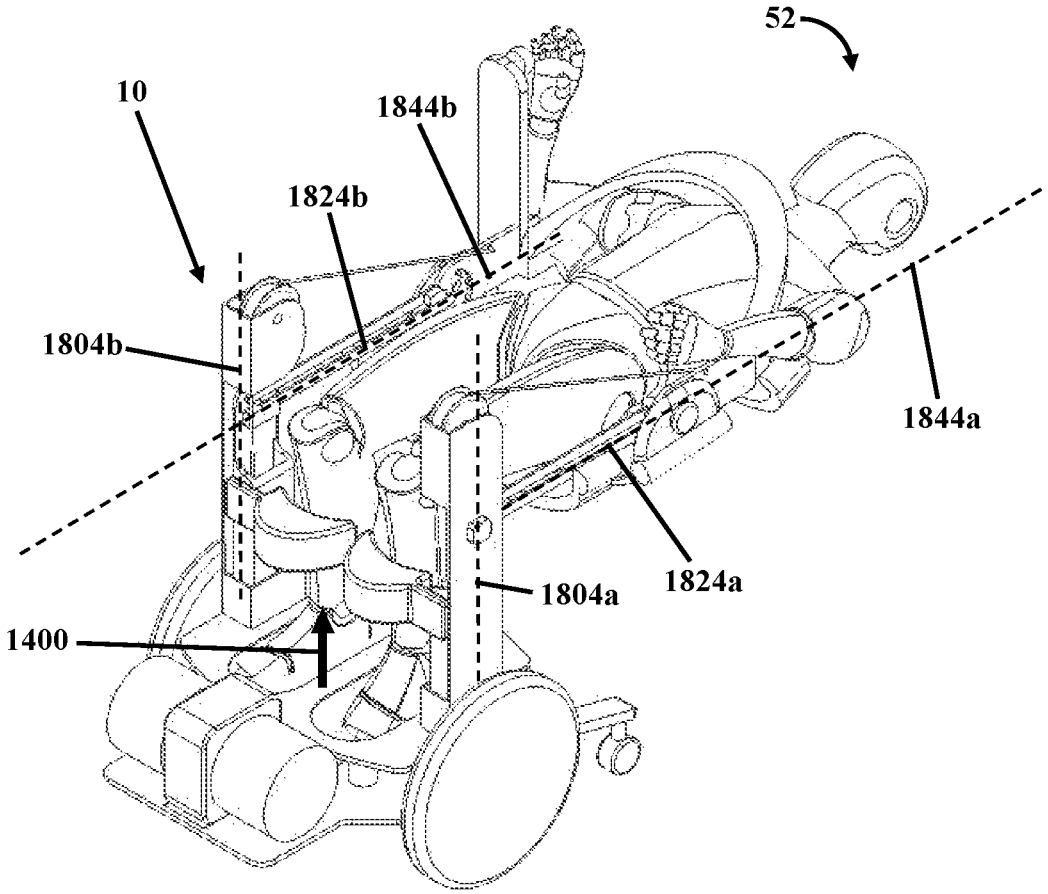
FIG. 6C illustrates a mobility device in a partially lying configuration, consistent with one or more exemplary embodiments of the present disclosure.
Figure 6D:
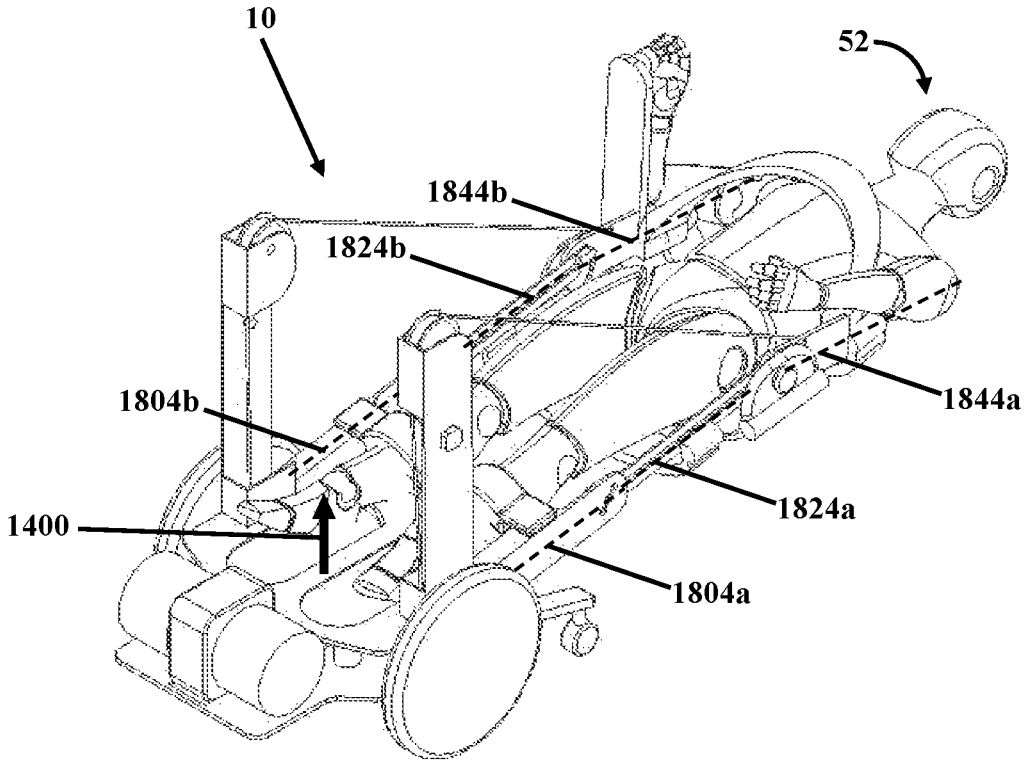
FIG. 6D illustrates a mobility device in a lying configuration, consistent with one or more exemplary embodiments of the present disclosure.

FIG. 6A illustrates mobility device 10 in a standing configuration, consistent with one or more exemplary embodiments of the present disclosure. FIG. 6B illustrates mobility device 10 in a sitting configuration, consistent with one or more exemplary embodiments of the present disclosure. FIG. 6C illustrates mobility device 10 in a partially lying configuration, consistent with one or more exemplary embodiments of the present disclosure. FIG. 6D illustrates mobility device 10 in a lying configuration, consistent with one or more exemplary embodiments of the present disclosure.

An exemplary method for enhancing the mobility of a user may include securing a user in a mobility device, for example securing user 52 in mobility device 10 by placing feet 60 of user 52 on a top surface 140 of the platform 14. An exemplary method may further include restraining translational and rotational movements of left crus 524*a* of user 52 relative to first left elongated segment 180*a* by attaching left leg attachment frame 50*a* to left crus 524*a* of user 52, and restraining translational and rotational movements of right crus 524*b* of user 52 relative to first right elongated segment 180*b* by attaching right leg attachment frame 50*b* to right crus 524*b* of user 52. An exemplary method may further include restraining translational and rotational movements of left thigh 528*a* of user 52 relative to second left elongated segment 182*a* by attaching left thigh attachment frame 54*a* to left thigh 528*a* of user 52 and restraining translational and rotational movements of right thigh 528*b* of user 52 relative to second right elongated segment 182*b* by attaching right thigh attachment frame 54*b* to right thigh 528*b* of user 52. An exemplary method may further include supporting hip 526 of user 52 by placing hip 526 of user 52 on left hip attachment frame 56*a* and right hip attachment frame 56*b*. An exemplary method may further include restraining translational and rotational movements of torso 5210 of the user relative to third left elongated segment 184*a* and third right elongated segment 184*b* by attaching left torso attachment frame 58*a* and right torso attachment frame 58*b* to torso 5210 of user 52.

In an exemplary embodiment, an exemplary method for enhancing the mobility of a user may include changing a posture of the user to a standing position, such as the position illustrated in FIG. 6A. In an exemplary embodiment, changing a posture of a user, such as user 52 who is secured in a mobility device such as mobility device 10 to a standing position may include pivoting first left elongated segment 180*a* relative to top surface of platform to an upright position of first left elongated segment 180*a*. As used herein, an upright position of first left elongated segment 180*a* may correspond to longitudinal axis 1804*a* of first left elongated segment 180*a* being parallel with normal axis 1400 of top surface 140 of platform 14. Changing the posture of user 52 to a standing position may further include pivoting first right elongated segment 180*b* relative to top surface of platform to an upright position of first right elongated segment 180*b*. As used herein, an upright position of first right elongated segment 180*b* may correspond to longitudinal axis 1804*b* of first right elongated segment 180*b* being parallel with normal axis 1400 of top surface 140 of platform 14.

In an exemplary embodiment, changing the posture of user 52 to a standing position may further include pivoting second left elongated segment 182*a* relative to first left elongated segment 180*a* to an upright position of second left elongated segment 182*a*. As used herein, an upright position of second left elongated segment 182*a* may correspond to longitudinal axis 1824*a* of second left elongated segment 182*a* being parallel with normal axis. Changing the posture of user 52 to a standing position may further include pivoting second right elongated segment 182*b* relative to first right elongated segment 182*b* to an upright position of second right elongated segment 182*b*. As used herein, an upright position of second right elongated segment 182*b* may correspond to longitudinal axis 1824*b* of second right elongated segment 182*b* being parallel with normal axis 1400.

In an exemplary embodiment, changing the posture of user 52 to a standing position may further include pivoting third left elongated segment 184*a* relative to second left elongated segment 182*a* to an upright position of third left elongated segment 184*a*. As used herein, an upright position of third left elongated segment 184*a* may correspond to longitudinal axis 1844*a* of third left elongated segment 184*a* being parallel with normal axis. Changing the posture of user 52 to a standing position may further include pivoting third right elongated segment 184*b* relative to second right elongated segment 182*b* to an upright position of third right elongated segment 184*b*. As used herein, an upright position of third right elongated segment 184*b* may correspond to longitudinal axis 1844*b* of third right elongated segment 184*b* being parallel with normal axis 1400.

In an exemplary embodiment, an exemplary method for enhancing the mobility of a user may include changing a posture of the user to a sitting position, such as the position illustrated in FIG. 6B. In an exemplary embodiment, changing a posture of user 52 to a sitting position may include pivoting first left elongated segment 180*a* relative to top surface of platform to an upright position of first left elongated segment 180*a*. Changing the posture of user 52 to a sitting position may further include pivoting first right elongated segment 180*b* relative to top surface of platform to an upright position of first right elongated segment 180*b*.

In an exemplary embodiment, changing the posture of user 52 to a sitting position may further include pivoting second left elongated segment 182*a* relative to first left elongated segment 180*a* to a horizontal position of second left elongated segment 182*a*. As used herein, a horizontal position of second left elongated segment 182*a* may correspond to longitudinal axis 1824*a* of second left elongated segment 182*a* being perpendicular to normal axis. Changing the posture of user 52 to a sitting position may further include pivoting second right elongated segment 182*b* relative to first right elongated segment 182*b* to a horizontal position of second right elongated segment 182*b*. As used herein, a horizontal position of second right elongated segment 182*b* may correspond to longitudinal axis 1824*b* of second right elongated segment 182*b* being perpendicular to normal axis 1400.

In an exemplary embodiment, changing the posture of user 52 to a sitting position may further include pivoting third left elongated segment 184*a* relative to second left elongated segment 182*a* to an upright position of third left elongated segment 184*a*. Changing the posture of user 52 to a sitting position may further include pivoting third right elongated segment 184*b* relative to second right elongated segment 182*b* to an upright position of third right elongated segment 184*b*.

In an exemplary embodiment, an exemplary method for enhancing the mobility of a user may include changing a posture of the user to a partially lying position, such as the position illustrated in FIG. 6C. In an exemplary embodiment, changing a posture of user 52 to a partially lying position may include pivoting first left elongated segment 180*a* relative to top surface of platform to an upright position of first left elongated segment 180*a*. Changing the posture of user 52 to a partially lying position may further include pivoting first right elongated segment 180*b* relative to top surface of platform to an upright position of first right elongated segment 180*b*.

In an exemplary embodiment, changing the posture of user 52 to a partially lying position may further include pivoting second left elongated segment 182*a* relative to first left elongated segment 180*a* to a horizontal position of second left elongated segment 182*a*. Changing the posture of user 52 to a partially lying position may further include pivoting second right elongated segment 182*b* relative to first right elongated segment 182*b* to a horizontal position of second right elongated segment 182*b*.

In an exemplary embodiment, changing the posture of user 52 to a partially lying position may further include pivoting third left elongated segment 184*a* relative to second left elongated segment 182*a* to a horizontal position of third left elongated segment 184*a*. As used herein, a horizontal position of third left elongated segment 184*a* may correspond to longitudinal axis 1844*a* of third left elongated segment 184*a* being perpendicular to normal axis 1400. Changing the posture of user 52 to a partially lying position may further include pivoting third right elongated segment 184*b* relative to second right elongated segment 182*b* to a horizontal position of third right elongated segment 184*b*. As used herein, a horizontal position of third right elongated segment 184*b* may correspond to longitudinal axis 1844*b* of third right elongated segment 184*b* being perpendicular to normal axis 1400.

In an exemplary embodiment, an exemplary method for enhancing the mobility of a user may include changing a posture of the user to a lying position, such as the position illustrated in FIG. 6D. In an exemplary embodiment, changing a posture of user 52 to a partially lying position may include pivoting first left elongated segment 180*a* relative to top surface of platform to a horizontal position of first left elongated segment 180*a*. As used herein, a horizontal position of first left elongated segment 180*a* may correspond to longitudinal axis 1804*a* of first left elongated segment 180*a* being perpendicular to normal axis 1400 of top surface 140 of platform 14. Changing the posture of user 52 to a lying position may further include pivoting first right elongated segment 180*b* relative to top surface of platform to a horizontal position of first right elongated segment 180*b*. As used herein, a horizontal position of first left elongated segment 180*b* may correspond to longitudinal axis 1804*b* of first left elongated segment 180*b* being perpendicular to normal axis 1400 of top surface 140 of platform 14.

In an exemplary embodiment, changing the posture of user 52 to a lying position may further include pivoting second left elongated segment 182*a* relative to first left elongated segment 180*a* to a horizontal position of second left elongated segment 182*a*. Changing the posture of user 52 to a lying position may further include pivoting second right elongated segment 182*b* relative to first right elongated segment 182*b* to a horizontal position of second right elongated segment 182*b*.

In an exemplary embodiment, changing the posture of user 52 to a lying position may further include pivoting third left elongated segment 184*a* relative to second left elongated segment 182*a* to a horizontal position of third left elongated segment 184*a*. Changing the posture of user 52 to a lying position may further include pivoting third right elongated segment 184*b* relative to second right elongated segment 182*b* to a horizontal position of third right elongated segment 184*b*.

According to one or more exemplary embodiments, the present disclosure is further directed to a method for enhancing the mobility of a user. An exemplary method for enhancing the mobility of a user may utilize a mobility device such as mobility device 10 to allow a disabled user to change their posture from a lying position as illustrated in FIG. 6D to a sitting position as illustrated in FIG. 6B or from a standing position as illustrated in FIG. 6A to a sitting position as illustrated in FIG. 6B.

In an exemplary embodiment changing the posture of a user, such as user 52 from a lying position to a standing position may include restraining a rotational movement of the second elongated segment relative to the first elongated segment of each support assembly of the pair of support assemblies by locking the second revolute joint of each support assembly in position. For example, the rotational movement of second left elongated segment 182*a* relative to first left elongated segment 180*a* may be restrained by locking second left revolute joint 1828*a*. In an exemplary embodiment, second left revolute joint 1828*a* may be a single-axis pin joint, where locking second left revolute joint 1828*a* may refer to restraining the rotational movement of a pin of the single-axis pin joint by utilizing a lock, such as a solenoid lock. Furthermore, the rotational movement of second right elongated segment 182*b* relative to first right elongated segment 180*b* may further be restrained by locking second right revolute joint 1828*b*. Locking mechanism of second right revolute joint 1828*b* may be similar to that of second left revolute joint 1828*a*.

In an exemplary embodiment changing the posture of a user, such as user 52 from a lying position to a standing position may further include pulling third left elongated segment 184*a* toward left idler pulley 1186*a* and pulling third right elongated segment 184*b* toward right idler pulley 1186*b*. In an exemplary embodiment, pulling third left elongated segment 184*a* toward left idler pulley 1186*a* may include winding left-side cable 1188*a* of actuator 118 around left rotating pulley 1184*a*. In an exemplary embodiment, pulling third right elongated segment 184*b* toward right idler pulley 1186*b* may include winding right-side cable 1188*b* of actuator 118 around right rotating pulley 1184*b*.

In an exemplary embodiment, changing the posture of user 52 from a lying position may for example start at a position illustrated in FIG. 6D, where longitudinal axes 1804*a-b*, 1824*a-b*, and 1844*a-b* may be perpendicular to normal axis 1400. As used herein, being perpendicular to may refer to making an angle of 90°±10° and being parallel with may refer to making an angle of 0°±10°. For example, longitudinal axis 1824*a* being perpendicular to normal axis 1400 may refer to an angle between second left elongated segment 182*a* and normal axis 1400 may be between 80° and 100°. To change the posture of user 52 from the lying position illustrated in FIG. 6D to a standing position illustrated in FIG. 6A, motor 1180 may drive a rotational movement of first shaft 1182, which may be transferred to left rotating pulley 1184*a* and right rotating pulley 1184*b*. Rotational movement of left rotating pulley 1184*a* may wind left-side cable 1188*a* around left rotating pulley 1184*a* and thereby pull third left elongated segment 184*a* toward left idle pulley 1186*a*. Third left revolute joint 1848*a* may allow third left elongated segment 184*a* to pivot about third pivot axis 1846 and rotate from the horizontal position of third left elongated segment 184*a* to an upright position of third left elongated segment 184*a*. Since, third left revolute joint 1848*a* only allows for a 90° pivot, further winding of left-side cable 1188*a* around left rotating pulley 1184*a* may pull first left elongated segment 180*a*, second left elongated segment 182*a*, and third left elongated segment 184*a* together toward left idle pulley 1186*a*. In other words, further winding of left-side cable 1188*a* may urge first left elongated segment 180*a*, second left elongated segment 182*a*, and third left elongated segment 184*a* to pivot about first pivot axis 1806 to a position where longitudinal axes 1804*a*, 1824*a*, and 1844*a* may be parallel with normal axis 1400.

In an exemplary embodiment, rotational movement of right rotating pulley 1184*b* may wind right-side cable 1188*b* around right rotating pulley 1184*b* and thereby pull third right elongated segment 184*b* toward right idle pulley 1186*b*. Third right revolute joint 1848*b* may allow third right elongated segment 184*b* to pivot about third pivot axis 1846 and rotate from the horizontal position of third right elongated segment 184*b* to an upright position of third right elongated segment 184*b*. Since, third right revolute joint 1848*b* only allows for a 90° pivot, further winding of right-side cable 1188*b* around right rotating pulley 1184*b* may pull first right elongated segment 180*b*, second right elongated segment 182*b*, and third right elongated segment 184*b* together toward right idle pulley 1186*b*. In other words, further winding of right-side cable 1188*b* may urge first right elongated segment 180*b*, second right elongated segment 182*b*, and third right elongated segment 184*b* to pivot about first pivot axis 1806 to a position where longitudinal axes 1804*b*, 1824*b*, and 1844*b* may be parallel with normal axis 1400.

In an exemplary embodiment changing the posture of a user, such as user 52 from a standing position to a sitting position may include restraining a rotational movement of first elongated segment of each support assembly of the pair of support assemblies with respect to top surface of platform by locking first revolute joint of each support assembly in position. For example, the rotational movement of first left elongated segment 180*a* relative to top surface 140 of platform 14 may be restrained by locking first left revolute joint 1808*a*. In an exemplary embodiment, first left revolute joint 1808*a* may be a single-axis pin joint, where locking first left revolute joint 1808*a* may refer to restraining the rotational movement of a pin of the single-axis pin joint by utilizing a lock, such as a solenoid lock. Furthermore, the rotational movement of first right elongated segment 180*b* relative to top surface 140 of platform 14 may further be restrained by locking first right revolute joint 1808*b*. Locking mechanism of first right revolute joint 1808*b* may be similar to that of first left revolute joint 1808*a*.

In an exemplary embodiment changing the posture of a user, such as user 52 from a standing position to a sitting position may further include driving a rotational movement of second left elongated segment 182*a* relative to first left elongated segment 180*a* from a first position to a second position. Driving a rotational movement of second left elongated segment 182*a* relative to first left elongated segment 180*a* may include unwinding left-side cable 1188*a* of actuator 118 around left rotating pulley 1184*a*. In an exemplary embodiment, the first position may correspond to longitudinal axis 1824*a* of second left elongated segment 182*a* being parallel with normal axis 1400 and second position may correspond to longitudinal axis 1824*a* of second left elongated segment 182*a* being perpendicular to with normal axis 1400.

In an exemplary embodiment, changing the posture of user 52 from a standing position may for example start at a position illustrated in FIG. 6A, where longitudinal axes 1804*a-b*, 1824*a-b*, and 1844*a-b* may be parallel with normal axis 1400. As used herein, being perpendicular to may refer to making an angle of 90°±10° and being parallel with may refer to making an angle of 0°±10°. For example, longitudinal axis 1824*a* being parallel with normal axis 1400 may refer to an angle between second left elongated segment 182*a* and normal axis 1400 may be between −10° and +10°. To change the posture of user 52 from the standing position illustrated in FIG. 6A to a sitting position illustrated in FIG. 6B, motor 1180 may drive a rotational movement of first shaft 1182, which may be transferred to left rotating pulley 1184*a* and right rotating pulley 1184*b*. Rotational movement of left rotating pulley 1184*a* may unwind left-side cable 1188*a* from around left rotating pulley 1184*a* and thereby release third left elongated segment 184*a* to move downward with respect to left idle pulley 1186*a*. Unwinding left-side cable 1188*a* may urge second left elongated segment 182*a* to pivot about second pivot axis 1826 to a position where longitudinal axis 1824*a* may be perpendicular to normal axis 1400.

Rotational movement of right rotating pulley 1184*b* may unwind right-side cable 1188*b* from around right rotating pulley 1184*b* and thereby release third right elongated segment 184*b* to move downward with respect to right idle pulley 1186*b*. Unwinding right-side cable 1188*b* may urge second right elongated segment 182*b* to pivot about second pivot axis 1826 to a position where longitudinal axis 1824*b* may be perpendicular to normal axis 1400.

Figure 7:
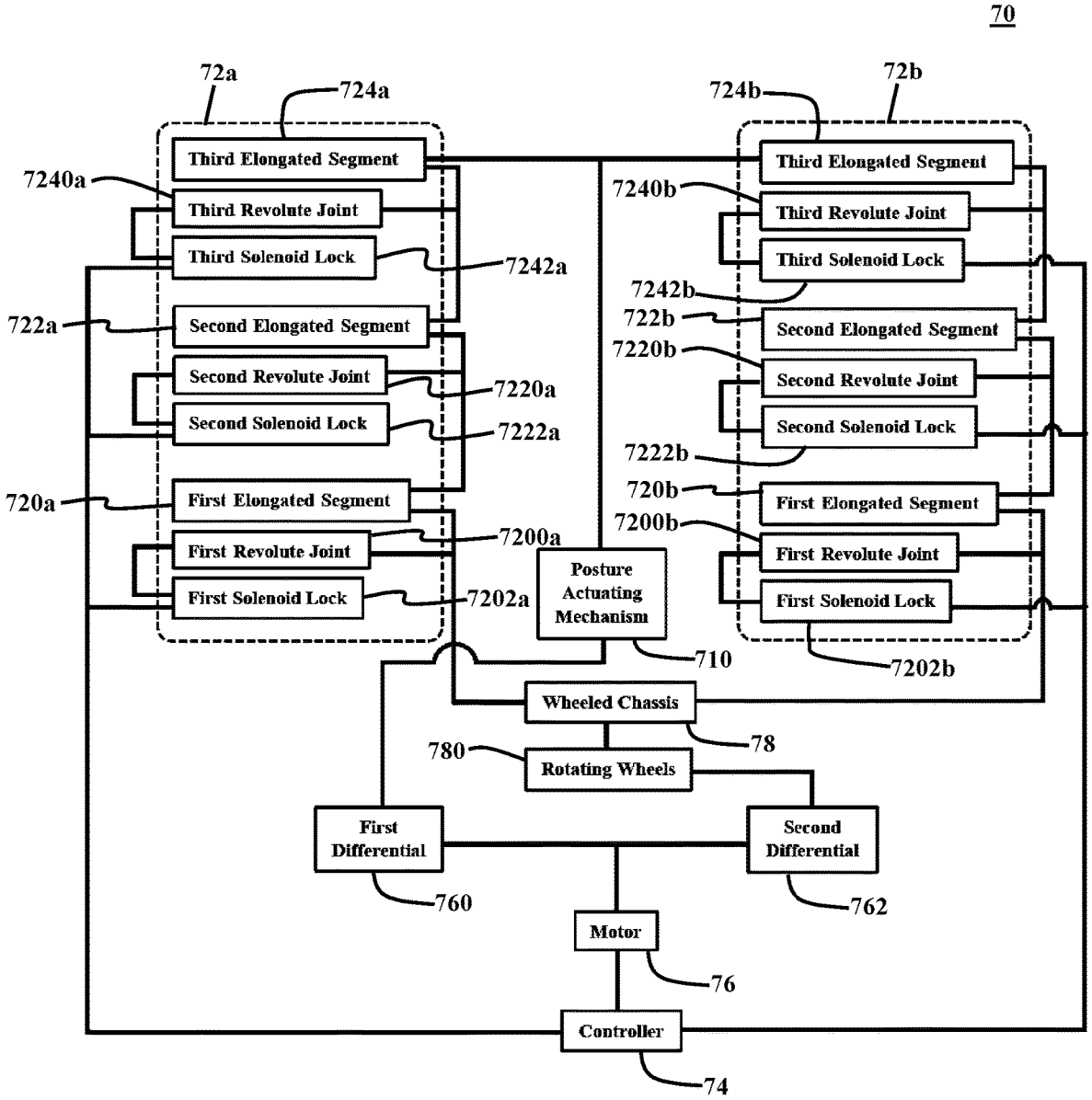
FIG. 7 illustrates a block diagram of a mobility system, consistent with one or more exemplary embodiments of the present disclosure.

FIG. 7 illustrates a block diagram of a mobility system 70, consistent with one or more exemplary embodiments of the present disclosure. In an exemplary embodiment, mobility device 10 may be an implementation of mobility system 70. In an exemplary embodiment, mobility system 70 may include a wheeled chassis 78 that may be structurally similar to wheeled chassis 12. In an exemplary embodiment, wheeled chassis 78 may include a pair of rotating wheels 780 that may be structurally similar to rotating wheels (120*a*, 120*b*). Each rotating wheel of the pair of rotating wheels 780 may be mounted at a respective side of wheeled chassis 78. In an exemplary embodiment, mobility system 70 may further include a motor 76 that may be similar to motor 1180. In an exemplary embodiment, motor 76 may be coupled with rotating wheels 780 via a second differential 762 that may be structurally similar to second differential 11812. In an exemplary embodiment, motor 76 may be configured to drive a rotational movement of rotating wheels 780.

In an exemplary embodiment, mobility system 70 may further include a pair of support assemblies (72*a*, 72*b*) that may be similar to left and right support assemblies (18*a*, 18*b*) and may similarly be mounted on a respective side of wheeled chassis 78. In an exemplary embodiment, each support assembly of pair of support assemblies (72*a*, 72*b*) may include a first elongated segment, a second elongated segment, and a third elongated segment. For example, support assembly 72*a* may include a first elongated segment 720*a* similar to first left elongated segment 180*a*, a second elongated segment 722*a* similar to second left elongated segment 182*a*, and a third elongated segment 724*a* similar to third left elongated segment 184*a*. Similarly, support assembly 72*b* may include a first elongated segment 720*b* similar to first right elongated segment 180*b*, a second elongated segment 722*b* similar to second right elongated segment 182*b*, and a third elongated segment 724*b* similar to third right elongated segment 184*b*.

In an exemplary embodiment, first elongated segment of each support assembly of pair of support assemblies (72*a*, 72*b*) may be pivotally coupled to wheeled chassis 78 by utilizing a first revolute joint. For example, first elongated segment 720*a* may be pivotally coupled to wheeled chassis 78 by utilizing a first revolute joint 7200*a* similar to first left revolute joint 1808*a*, while first elongated segment 720*b* may be pivotally coupled to wheeled chassis 78 by utilizing a first revolute joint 7200*b* similar to first right revolute joint 1808*b*. In an exemplary embodiment, the second elongated segment of each support assembly of pair of support assemblies (72*a*, 72*b*) may be pivotally coupled to the first elongated segment of each respective support assembly of support assemblies (72*a*, 72*b*). For example, second elongated segment 722*a* may be pivotally coupled with first elongated segment 720*a*, and second elongated segment 722*b* may be pivotally coupled with first elongated segment 720*b*. In an exemplary embodiment, the third elongated segment of each support assembly of pair of support assemblies (72*a*, 72*b*) may be pivotally coupled to the second elongated segment of each respective support assembly of support assemblies (72*a*, 72*b*). For example, third elongated segment 724*a* may be pivotally coupled with second elongated segment 722*a*, and third elongated segment 724*b* may be pivotally coupled with second elongated segment 722*b*.

In an exemplary embodiment, each of the revolute joints that may be utilized for coupling the three elongated segment to one another and to wheeled chassis 78 may be equipped with a locking mechanism, such as a solenoid lock that upon actuation may lock each of the revolute joints. For example, first revolute joint 7200*a* may be equipped with first solenoid lock 7202*a*, where first solenoid lock 7202*a* may be configured to lock pivotal movement of first revolute joint 7200*a*, upon actuation of first solenoid lock 7202*a*. In an exemplary embodiment, second revolute joint 7220*a* may be equipped with second solenoid lock 7222*a*, where second solenoid lock 7222*a* may be configured to lock pivotal movement of second revolute joint 7200*a*, upon actuation of second solenoid lock 7222*a*. In an exemplary embodiment, third revolute joint 7240*a* may be equipped with third solenoid lock 7242*a*, where third solenoid lock 7242*a* may be configured to lock pivotal movement of third revolute joint 7240*a*, upon actuation of third solenoid lock 7242*a*.

In an exemplary embodiment, first revolute joint 7200*b* may be equipped with first solenoid lock 7202*b*, where first solenoid lock 7202*b* may be configured to lock pivotal movement of first revolute joint 7200*b*, upon actuation of first solenoid lock 7202*b*. In an exemplary embodiment, second revolute joint 7220*b* may be equipped with second solenoid lock 7222*b*, where second solenoid lock 7222*b* may be configured to lock pivotal movement of second revolute joint 7200*b*, upon actuation of second solenoid lock 7222*b*. In an exemplary embodiment, third revolute joint 7240*b* may be equipped with third solenoid lock 7242*b*, where third solenoid lock 7242*b* may be configured to lock pivotal movement of third revolute joint 7240*b*, upon actuation of third solenoid lock 7242*b*.

In an exemplary embodiment, mobility system 70 may further include a posture actuating mechanism 710 that may be coupled to motor 76 via a first differential 760 similar to first differential 1182. In an exemplary embodiment, actuating mechanism 710 together with motor 76 may form an actuator that may be similar to actuator 118 of mobility device 10. In an exemplary embodiment, posture actuating mechanism 710 may be coupled to the third elongated segment of each support assembly of support assemblies (72*a*, 72*b*).

In an exemplary embodiment, mobility system 70 may further include a controller 74 that may be coupled with motor 76. In an exemplary embodiment, controller 74 may be configured to control back and forth translational movements of wheeled chassis 78 by sending actuation commands to motor 76 to urge motor 76 to drive rotational movements of rotating wheels 780 via second differential 762. In an exemplary embodiment, controller 74 may further be configured to receive steering commands from a user via a user interface unit, such as a joystick mounted on mobility device or a remote controller held by the user.

In an exemplary embodiment, controller 74 may further be coupled to solenoid locks of each support assembly of support assemblies (72*a*, 72*b*). For example, controller 74 may be coupled to first solenoid locks (7202*a*, 7202*b*), second solenoid locks (7222*a*, 7222*b*), and third solenoid locks (7242*a*, 7242*b*). In an exemplary embodiment, controller 74 may further be configured to actuate first solenoid locks (7202*a*, 7202*b*), second solenoid locks (7222*a*, 7222*b*), and third solenoid locks (7242*a*, 7242*b*) between locked and opened positions. As used herein, in locked position, each of the solenoid locks may prevent a respective revolute joint of each support assembly of support assemblies (72*a*, 72*b*) from assuming a rotational movement. For example, first solenoid lock 7202*a*, upon receiving an actuating command from controller 74 may lock first revolute joint 7200*a*, such that first revolute joint 7200*a* may not assume a rotational movement in this locked position.

In an exemplary embodiment, after securing a user to mobility system 70, which may be carried out similar to securing a user to mobility device 10, controller 74 may be configured to change a posture of the user from a lying position to a standing position. As used herein, the lying position may correspond to the first elongated segment, the second elongated segment, and the third elongated segment of each support assembly of pair of support assemblies (72*a*, 72*b*) being perpendicular to a normal axis of wheeled chassis 78. For example, a lying position in mobility system 70 may be similar to a lying position in mobility device 10, as shown in FIG. 6D. As used herein, the standing position may correspond to the first elongated segment, the second elongated segment, and the third elongated segment of each support assembly of pair of support assemblies (72*a*, 72*b*) being parallel to the normal axis of wheeled chassis 78. For example, a sitting position in mobility system 70 may be similar to a sitting position in mobility device 10, as shown in FIG. 6B.

In an exemplary embodiment, controller 74 may be configured to change a posture of the user from a lying position to a standing position by restraining a rotational movement of the second elongated segment relative to the first elongated segment of each support assembly of pair of support assemblies (72*a*, 72*b*) by urging the second solenoid lock of each support assembly of pair of support assemblies (72*a*, 72*b*) to lock the second revolute joint of each support assembly of pair of support assemblies (72*a*, 72*b*) in position. For example, controller 74 may urge second solenoid lock 7222*a* to lock second revolute joint 7220*a* and second solenoid lock 7222*b* to lock second revolute joint 7220*b*. In an exemplary embodiment, controller 74 may be configured to change a posture of the user from a lying position to a standing position by further urging posture actuating mechanism 710 to pull the third elongated segment of each support assembly of pair of support assemblies (72*a*, 72*b*) upwardly.

In an exemplary embodiment, controller 74 may be configured to change a posture of the user from a standing position to a sitting position by restraining a rotational movement of the first elongated segment of each support assembly of pair of support assemblies (72*a*, 72*b*) relative to a top surface of wheeled chassis 78 by urging the first solenoid lock of each support assembly of pair of support assemblies (72*a*, 72*b*) to lock the first revolute joint of each support assembly of pair of support assemblies (72*a*, 72*b*) in position. For example, controller 74 may urge first solenoid lock 7202*a* to lock first revolute joint 7200*a* and first solenoid lock 7202*b* to lock first revolute joint 7200*b*. In an exemplary embodiment, controller 74 may be configured to change a posture of the user from a standing position to a sitting position by further urging posture actuating mechanism 710 to release and allow the third elongated segment of each support assembly of pair of support assemblies (72*a*, 72*b*) to move downwardly. In an exemplary embodiment, considering the locked first revolute joint of each support assembly of pair of support assemblies (72*a*, 72*b*), such release of the third elongated segment of each support assembly of pair of support assemblies (72*a*, 72*b*) may lead to a rotational movement of the second elongated segment of each support assembly of pair of support assemblies (72*a*, 72*b*) relative to the first elongated segment of each support assembly of pair of support assemblies (72*a*, 72*b*) from a first position to a second position. In an exemplary embodiment, the first position may correspond to the second elongated segment of each support assembly of pair of support assemblies (72*a*, 72*b*) being parallel with the normal axis of wheeled chassis 78. In an exemplary embodiment, the second position may correspond to the second elongated segment of each support assembly of pair of support assemblies (72*a*, 72*b*) being perpendicular to the normal axis of wheeled chassis 78.

Figure 8:
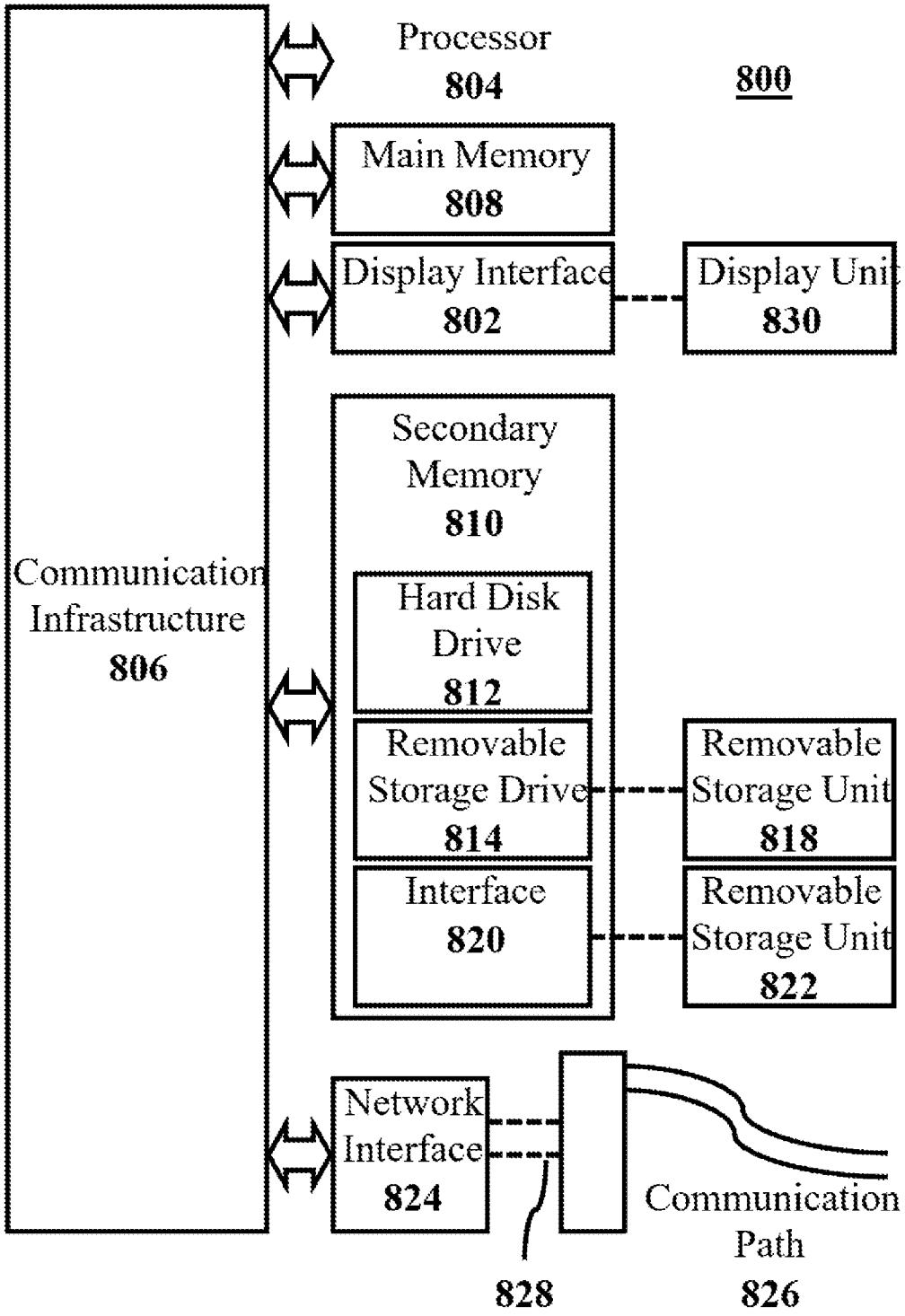
FIG. 8 illustrates a high-level functional block diagram of a computer system, in which an embodiment of the present invention, or portions thereof, may be implemented as computer-readable code, consistent with exemplary embodiments of the present disclosure.

FIG. 8 illustrates a high-level functional block diagram of a computer system 800, in which an embodiment of the present invention, or portions thereof, may be implemented as computer-readable code, consistent with exemplary embodiments of the present disclosure. For example, controller 74 may be implemented in computer system 800 using hardware, software, firmware, tangible computer-readable media having instructions stored thereon, or a combination thereof and may be implemented in one or more computer systems or other processing systems.

If programmable logic is used, such logic may execute on a commercially available processing platform or a special purpose device. One ordinary skill in the art may appreciate that an embodiment of the disclosed subject matter can be practiced with various computer system configurations, including multi-core multiprocessor systems, minicomputers, mainframe computers, computers linked or clustered with distributed functions, as well as pervasive or miniature computers that may be embedded into virtually any device.

For instance, a computing device having at least one processor device and a memory may be used to implement the above-described embodiments. A processor device may be a single processor, a plurality of processors, or combinations thereof. Processor devices may have one or more processor "cores."

An embodiment of the invention is described in terms of this example computer system 800. After reading this description, it will become apparent to a person skilled in the relevant art how to implement the invention using other computer systems and/or computer architectures. Although operations may be described as a sequential process, some of the operations may be performed in parallel, concurrently, and/or in a distributed environment, and with program code stored locally or remotely for access by single or multiprocessor machines. Also, in some embodiments, the order of operations may be rearranged without departing from the spirit of the disclosed subject matter.

Processor device 804 may be a special purpose or a general-purpose processor device. As will be appreciated by persons skilled in the relevant art, processor device 804 may also be a single processor in a multi-core/multiprocessor system, such system operating alone, or in a cluster of computing devices operating in a cluster or server farm. Processor device 804 may be connected to a communication infrastructure 806, for example, a bus, message queue, network, or multi-core message-passing scheme.

In an exemplary embodiment, computer system 800 may include a display interface 802, for example, a video connector, to transfer data to a display unit 830, for example, a monitor. Computer system 800 may also include a main memory 808, for example, random access memory (RAM), and may also include a secondary memory 810. Secondary memory 810 may include, for example, a hard disk drive 812, and a removable storage drive 814. Removable storage drive 814 may include a floppy disk drive, a magnetic tape drive, an optical disk drive, a flash memory, or the like. Removable storage drive 814 may read from and/or write to a removable storage unit 818 in a well-known manner. Removable storage unit 818 may include a floppy disk, a magnetic tape, an optical disk, etc., which may be read by and written to by removable storage drive 814. As will be appreciated by persons skilled in the relevant art, removable storage unit 818 may include a computer-usable storage medium having stored therein computer software and/or data.

In alternative implementations, secondary memory 810 may include other similar means for allowing computer programs or other instructions to be loaded into computer system 800. Such means may include, for example, a removable storage unit 822 and an interface 820. Examples of such means may include a program cartridge and cartridge interface (such as that found in video game devices), a removable memory chip (such as an EPROM, or PROM) and associated socket, and other removable storage units 822 and interfaces 820 which allow software and data to be transferred from removable storage unit 822 to computer system 800.

Computer system 800 may also include a communications interface 824. Communications interface 824 allows software and data to be transferred between computer system 800 and external devices. Communications interface 824 may include a modem, a network interface (such as an Ethernet card), a communications port, a PCMCIA slot, and card, or the like. Software and data transferred via communications interface 824 may be in the form of signals, which may be electronic, electromagnetic, optical, or other signals capable of being received by communications interface 824. These signals may be provided to communications interface 824 via a communications path 826. Communications path 826 carries signals and may be implemented using wire or cable, fiber optics, a phone line, a cellular phone link, an RF link or other communications channels.

In this document, the terms "computer program medium" and "computer usable medium" are used to generally refer to media such as removable storage unit 818, removable storage unit 822, and a hard disk installed in hard disk drive 812. Computer program medium and computer-usable medium may also refer to memories, such as main memory 808 and secondary memory 810, which may be memory semiconductors (e.g. DRAMs, etc.).

Computer programs (also called computer control logic) are stored in main memory 808 and/or secondary memory 810. Computer programs may also be received via communications interface 824. Such computer programs, when executed, enable computer system 800 to implement different embodiments of the present disclosure as discussed herein. In particular, the computer programs, when executed, enable processor device 804 to implement the processes of the present disclosure, such as the operations in system 60. Accordingly, such computer programs represent controllers of computer system 800. Where an exemplary embodiment of controller 66 is implemented using software, the software may be stored in a computer program product and loaded into computer system 800 using removable storage drive 814, interface 820, and hard disk drive 812, or communications interface 824.

Embodiments of the present disclosure also may be directed to computer program products including software stored on any computer useable medium. Such software, when executed in one or more data processing devices, causes a data processing device to operate as described herein. An embodiment of the present disclosure may employ any computer useable or readable medium. Examples of computer useable mediums include, but are not limited to, primary storage devices (e.g., any type of random access memory), secondary storage devices (e.g., hard drives, floppy disks, CD ROMS, ZIP disks, tapes, magnetic storage devices, and optical storage devices, MEMS, nanotechnological storage device, etc.).

The embodiments have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the disclosure that others can, by applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for description and not of limitation, such that the terminology or phraseology of the present specification is to be interpreted by the skilled artisan in light of the teachings and guidance.

The breadth and scope of the present disclosure should not be limited by any of the above-described exemplary embodiments but should be defined only in accordance with the following claims and their equivalents.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps. Moreover, the word "substantially" when used with an adjective or adverb is intended to enhance the scope of the particular characteristic; e.g., substantially planar is intended to mean planar, nearly planar and/or exhibiting characteristics associated with a planar element. Further use of relative terms such as "vertical", "horizontal", "up", "down", and "side-to-side" are used in a relative sense to the normal orientation of the apparatus.

What is claimed is:

1. A mobility device, comprising:

a wheeled chassis;

a platform mounted on the wheeled chassis, a top surface of the platform configured to support a user's feet;

a pair of extended bars, a respective proximal end of each extended bar of the pair of extended bars attached to a respective side of the platform, each extended bar of the pair of extended bars extended between the respective proximal end of each extended bar of the pair of extended bars and a respective distal end of each extended bar of the pair of extended bars, a respective longitudinal axis of each extended bar of the pair of extended bars perpendicular to the top surface of the platform;

a pair of support assemblies, each of the pair of support assemblies mounted on a respective side of the platform, each of the pair of support assemblies comprising:

a first elongated segment extended between a proximal end of the first elongated segment and a distal end of the first elongated segment, the proximal end of the first elongated segment pivotally coupled with the proximal end of a respective extended bar of the pair of extended bars;

a second elongated segment extended between a proximal end of the second elongated segment and a distal end of the second elongated segment, the proximal end of the second elongated segment pivotally coupled with the distal end of the first elongated segment; and a third elongated segment extended between a proximal end of the third elongated segment and a distal end of the third elongated segment, the proximal end of the third elongated segment pivotally coupled with the distal end of the second elongated segment;

a pair of leg attachment frames, each leg attachment frame of the pair of leg attachment frames attached to the first elongated segment of each respective support assembly of the pair of support assemblies, each leg attachment frame of the pair of leg attachment frames configured to secure a respective crus of the user to the first elongated segment of each respective support assembly of the pair of support assemblies;

a pair of thigh attachment frames, each thigh attachment frame of the pair of thigh attachment frames attached to the second elongated segment of each respective support assembly of the pair of support assemblies, each thigh attachment frame of the pair of thigh attachment frames configured to secure a respective thigh of the user to the second elongated segment of each respective support assembly of the pair of support assemblies;

a pair of hip support frames, each hip support frame of the pair of hip support frames attached to the third elongated segment of each respective support assembly of the pair of support assemblies, the pair of hip support frames configured to support a hip of the user;

a pair of torso attachment frames, each torso attachment frame of the pair of torso attachment frames attached to the distal end of the third elongated segment of each respective support assembly of the pair of support assemblies, the pair of torso attachment frames configured to support a torso of the user; and a pair of actuators, each actuator of the pair of actuators coupled between the distal end of a respective extended bar of the pair of extended bars and the third elongated segment of a respective support assembly of the pair of support assemblies, the pair of actuators configured to drive pivotal movements of the pair of support assemblies.

2. The device of claim 1, wherein each support assembly of the pair of support assemblies further comprises:

a first revolute joint connected between the proximal end of the first elongated segment and the wheeled chassis, the first revolute joint configured to allow a pivotal movement of the first elongated segment relative to the wheeled chassis;

a second revolute joint connected between the proximal end of the second elongated segment and the distal end of the first elongated segment, the second revolute joint configured to allow for a pivotal movement of the second elongated segment relative to the first elongated segment; and a third revolute joint connected between the proximal end of the third elongated segment and the distal end of the second elongated segment, the third revolute joint configured to allow for a pivotal movement of the third elongated segment relative to the second elongated segment.

3. The device of claim 2, wherein each actuator of the pair of actuators comprises:

a motor;

a rotating pulley coupled to the motor via a motor shaft, the motor configured to drive a rotational movement of the rotating pulley;

an idler pulley coupled to the distal end of a respective extended bar of the pair of extended bars;

a cable coupled between the rotating pulley and the third elongated segment of a respective support assembly of the pair of support assemblies, a first end of the cable coupled with the rotating pulley, the cable extended along the respective extended bar from the first end and further coupled with the idler pulley, the cable further extended to a second end of the cable, the second end of the cable attached to the third segment of the respective support assembly.

4. The device of claim 3, wherein the first elongated segment of each support assembly of the pair of support assemblies is pivotable about the first revolute joint from a first position to a second position, the first position corresponding to the first elongated segment being parallel with a respective extended bar of the pair of extended bars, the second position corresponding to the first elongated segment being perpendicular to the respective extended bar of the pair of extended bars.

5. The device of claim 4, wherein in the first position of the first elongated segment of each support assembly of the pair of support assemblies, the respective extended bar of the pair of extended bars extends beyond the distal end of the first elongated segment along the longitudinal axis of the respective extended bar, such that the distal end of the first elongated segment is positioned between a respective proximal end and a respective distal end of the respective extended bar.

6. The device of claim 3, wherein the wheeled chassis comprises:

a pair of rotating wheels, each rotating wheel of the pair of rotating wheels mounted at a respective side of the wheeled chassis, the pair of rotating wheels coupled with the motor, the motor further configured to drive a rotational movement of the pair of rotating wheels; and a pair of idle wheels, each idle wheel of the pair of idle wheels mounted at a respective side of the wheeled chassis.

7. The device of claim 2, wherein the first revolute joint, the second revolute joint, and the third revolute joint comprise single-axis pin joints, each single-axis pin joint of the single-axis pin joints configured to be rotatable between 0° and 90° about a longitudinal axis of each single-axis pin joint, the longitudinal axis of each single-axis pin joint perpendicular to the normal axis.

8. The device of claim 1, wherein each leg attachment frame of the pair of leg attachment frames comprises a first curved member attached to the first segment of a respective support assembly of the pair of support assemblies, a longitudinal axis of the first curved member perpendicular to a longitudinal axis of the first elongated segment, the longitudinal axis of the first curved member corresponding to an axis of the first curved member associated with the longest dimension of the first curved member, each leg attachment frame of the pair of leg attachment frames configured to restrain any translational or rotational movements of a respective curs of the user relative to the first segment of each support assembly of the pair of support assemblies.

9. The device of claim 8, wherein each thigh attachment frame of the pair of thigh attachment frames comprises a second curved member attached to the second segment of a respective support assembly of the pair of support assemblies, a longitudinal axis of the second curved member perpendicular to a longitudinal axis of the second elongated segment, the longitudinal axis of the second curved member corresponding to an axis of the second curved member associated with the longest dimension of the second curved member, each thigh attachment frame of the pair of thigh attachment frames configured to restrain any translational or rotational movements of a respective thigh of the user relative to the second segment of each support assembly of the pair of support assemblies.

10. The device of claim 9, wherein the pair of torso attachment frames further configured to restrain any translational or rotational movements of the torso of the user relative to the third segment of each support assembly of the pair of support assemblies.

11. A method of enhancing the mobility of a user, the method comprising:

securing the user in a mobility device, the mobility device comprising:

a wheeled chassis;

a platform mounted on the wheeled chassis;

a pair of support assemblies, each of the pair of support assemblies mounted on a respective side of the platform, each of the pair of support assemblies comprising:

a first elongated segment extended between a proximal end of the first elongated segment and a distal end of the first elongated segment, the proximal end of the first elongated segment pivotally coupled with the wheeled chassis;

a second elongated segment extended between a proximal end of the second elongated segment and a distal end of the second elongated segment, the proximal end of the second elongated segment pivotally coupled with the distal end of the first elongated segment; and a third elongated segment extended between a proximal end of the third elongated segment and a distal end of the third elongated segment, the proximal end of the third elongated segment pivotally coupled with the distal end of the second elongated segment;

a pair of extended bars, a respective proximal end of each extended bar of the pair of extended bars attached to a respective side of the platform, each extended bar of the pair of extended bars extended between the respective proximal end of each extended bar of the pair of extended bars and a respective distal end of each extended bar of the pair of extended bars, a respective longitudinal axis of each extended bar of the pair of extended bars perpendicular to the top surface of the platform;

a pair of leg attachment frames, each leg attachment frame attached to the first elongated segment of each respective support assembly of the pair of support assemblies;

a pair of thigh attachment frames, each thigh attachment frame attached to the first elongated segment of each respective support assembly of the pair of support assemblies;

a pair of hip support frames, each hip support frame attached to the third elongated segment of each respective support assembly of the pair of support assemblies;

a pair of torso attachment frames, each torso attachment frame attached to the distal end of the third elongated segment of each respective support assembly of the pair of support assemblies; and a pair of actuators, each actuator of the pair of actuators coupled between the distal end of a respective extended bar of the pair of extended bars and the third elongated segment of a respective support assembly of the pair of support assemblies;

wherein securing the user in the mobility device comprises:

placing feet of the user on a top surface of the platform;

restraining translational and rotational movements of each crus of the user relative to the first elongated segment of a respective support assembly of the pair of support assemblies by attaching each leg attachment frame of the pair of leg attachment frames to a respective crus of the user;

restraining translational and rotational movements of each thigh of the user relative to the second elongated segment of a respective support assembly of the pair of support assemblies by attaching each thigh attachment frame of the pair of thigh attachment frames to a respective thigh of the user;

supporting a hip of the user by placing the hip of the user in contact with front surfaces of the pair of hip support frames;

restraining translational and rotational movements of a torso of the user relative to the third elongated segment of a respective support assembly of the pair of support assemblies by attaching the pair of torso attachment frames to the torso of the user;

changing a posture of the user to a standing position by:

pivoting the first elongated segment of each support assembly of the pair of support assemblies relative to the top surface of the platform to an upright position of the first elongated segment of each support assembly, the upright position of the first elongated segment of each support assembly corresponding to a longitudinal axis of the first elongated segment of each support assembly parallel with a normal axis of the top surface of the platform, the normal axis perpendicular to the top surface;

pivoting the second elongated segment of each support assembly of the pair of support assemblies relative to the first elongated segment of each support assembly to an upright position of the second elongated segment of each support assembly, the upright position of the second elongated segment of each support assembly corresponding to a longitudinal axis of the second elongated segment of each support assembly parallel with the normal axis; and pivoting the third elongated segment of each support assembly of the pair of support assemblies relative to the second elongated segment of each support assembly to an upright position of the third elongated segment of each support assembly, the upright position of the third elongated segment of each support assembly corresponding to a longitudinal axis of the third elongated segment of each support assembly parallel with the normal axis.

12. The method of claim 11, further comprising:

changing a posture of the user to a sitting position by:

pivoting the first elongated segment of each support assembly of the pair of support assemblies relative to the top surface of the platform to the upright position of the first elongated segment of each support assembly;

pivoting the second elongated segment of each support assembly of the pair of support assemblies relative to the first elongated segment of each support assembly to a horizontal position of the second elongated segment of each support assembly, the horizontal position of the second elongated segment of each support assembly corresponding to the longitudinal axis of the second elongated segment of each support assembly perpendicular to the normal axis; and pivoting the third elongated segment of each support assembly of the pair of support assemblies relative to the second elongated segment of each support assembly to the upright position of the third elongated segment of each support assembly.

13. The method of claim 12, further comprising:

changing a posture of the user to a partially lying position by:

pivoting the first elongated segment of each support assembly of the pair of support assemblies relative to the top surface of the platform to the upright position of the first elongated segment of each support assembly;

pivoting the second elongated segment of each support assembly of the pair of support assemblies relative to the first elongated segment of each support assembly to the horizontal position of the second elongated segment of each support assembly; and pivoting the third elongated segment of each support assembly of the pair of support assemblies relative to the second elongated segment of each support assembly to a horizontal position of the third elongated segment of each support assembly, the horizontal position of the third elongated segment of each support assembly corresponding to the longitudinal axis of the third elongated segment of each support assembly perpendicular to the normal axis.

14. The method of claim 13, further comprising:

changing a posture of the user to a lying position by:

pivoting the first elongated segment of each support assembly of the pair of support assemblies relative to the top surface of the platform to a horizontal position of the first elongated segment of each support assembly, the horizontal position of the first elongated segment of each support assembly corresponding to the longitudinal axis of the first elongated segment of each support assembly perpendicular to the normal axis of the top surface of the platform, the normal axis perpendicular to the top surface;

pivoting the second elongated segment of each support assembly of the pair of support assemblies relative to the first elongated segment of each support assembly to the horizontal position of the second elongated segment of each support assembly; and pivoting the third elongated segment of each support assembly of the pair of support assemblies relative to the second elongated segment of each support assembly to the horizontal position of the third elongated segment of each support assembly.

15. A method of enhancing the mobility of a user, the method comprising:

securing the user in a mobility device, the mobility device comprising:

a wheeled chassis;

a platform mounted on the wheeled chassis;

a pair of support assemblies, each of the pair of support assemblies mounted on a respective side of the platform, each of the pair of support assemblies comprising:

a first elongated segment extended between a proximal end of the first elongated segment and a distal end of the first elongated segment, the proximal end of the first elongated segment pivotally coupled with the wheeled chassis utilizing a first revolute joint, a longitudinal axis of the first elongated segment parallel with a normal axis of a top surface of the platform, the normal axis perpendicular to the top surface;

a second elongated segment extended between a proximal end of the second elongated segment and a distal end of the second elongated segment, the proximal end of the second elongated segment pivotally coupled with the distal end of the first elongated segment utilizing a second revolute joint, a longitudinal axis of the second elongated segment parallel with the normal axis; and a third elongated segment extended between a proximal end of the third elongated segment and a distal end of the third elongated segment, the proximal end of the third elongated segment pivotally coupled with the distal end of the second elongated segment utilizing a third revolute joint, a longitudinal axis of the third elongated segment parallel with the normal axis;

a pair of extended bars, a respective proximal end of each extended bar of the pair of extended bars attached to a respective side of the platform, each extended bar of the pair of extended bars extended between the respective proximal end of each extended bar of the pair of extended bars and a respective distal end of each extended bar of the pair of extended bars, a respective longitudinal axis of each extended bar of the pair of extended bars perpendicular to the top surface of the platform;

a pair of leg attachment frames, each leg attachment frame attached to the first elongated segment of each respective support assembly of the pair of support assemblies;

a pair of thigh attachment frames, each thigh attachment frame attached to the first elongated segment of each respective support assembly of the pair of support assemblies;

a pair of hip support frames, each hip support frame attached to the third elongated segment of each respective support assembly of the pair of support assemblies;

a pair of torso attachment frames, each torso attachment frame attached to the distal end of the third elongated segment of each respective support assembly of the pair of support assemblies; and a pair of actuators, each actuator of the pair of actuators comprising:

a motor;

a rotating pulley coupled to the motor via a motor shaft, the motor configured to drive a rotational movement of the rotating pulley;

an idler pulley coupled to the distal end of a respective extended bar of the pair of extended bars; and a cable coupled between the rotating pulley and the third elongated segment of a respective support assembly of the pair of support assemblies, a first end of the cable coupled with the rotating pulley, the cable extended along the respective extended bar from the first end and further coupled with the idler pulley, the cable further extended to a second end of the cable, the second end of the cable attached to the third segment of the respective support assembly;

wherein securing the user in the mobility device comprises:

placing feet of the user on a top surface of the platform;

restraining translational and rotational movements of each crus of the user relative to the first elongated segment of a respective support assembly of the pair of support assemblies by attaching each leg attachment frame of the pair of leg attachment frames to a respective crus of the user;

restraining translational and rotational movements of each thigh of the user relative to the second elongated segment of a respective support assembly of the pair of support assemblies by attaching each thigh attachment frame of the pair of thigh attachment frames to a respective thigh of the user;

supporting a hip of the user by placing the hip of the user in contact with front surfaces of the pair of hip support frames; and restraining translational and rotational movements of a torso of the user relative to the third elongated segment of a respective support assembly of the pair of support assemblies by attaching the pair of torso attachment frames to the torso of the user.

16. The method of claim 15, further comprising changing the posture of the user from a lying position to a standing position, the lying position corresponding to the first elongated segment, the second elongated segment, and the third elongated segment of each support assembly of the pair of support assemblies being perpendicular to the normal axis, the standing position corresponding to the first elongated segment, the second elongated segment, and the third elongated segment of each support assembly of the pair of support assemblies being parallel to the normal axis, changing the posture of the user from the lying position to the sitting position comprising:

restraining a rotational movement of the second elongated segment relative to the first elongated segment of each support assembly of the pair of support assemblies by locking the second revolute joint of each support assembly in position; and pulling the third elongated segment of each support assembly of the pair of support assemblies toward the idler pulley of a respective actuator of the pair of actuators by winding the cable of the respective actuator of the pair of actuators around the rotating pulley of the respective actuator of the pair of actuators.

17. The method of claim 16, further comprising changing the posture of the user from the standing position to a sitting position, the sitting position corresponding to the first elongated segment and the third elongated segment of each support assembly of the pair of support assemblies being parallel with the normal axis and the second elongated segment of each support assembly of the pair of support assemblies being perpendicular to the normal axis, changing the posture of the user from the standing position to the sitting position comprising:

restraining a rotational movement of the first elongated segment of each support assembly of the pair of support assemblies relative to the top surface of the platform by locking the first revolute joint of each support assembly in position;

driving a rotational movement of the second elongated segment of each support assembly of the pair of support assemblies relative to the first elongated segment of each support assembly of the pair of support assemblies from a first position to a second position by unwinding the cable of the respective actuator of the pair of actuators, the first position corresponding to the second elongated segment of each support assembly of the pair of support assemblies being parallel with the normal axis, the second position corresponding to the second elongated segment of each support assembly of the pair of support assemblies being perpendicular to the normal axis.

* * * * *